US011286709B2

(12) United States Patent
Bernhagen et al.

(10) Patent No.: US 11,286,709 B2
(45) Date of Patent: Mar. 29, 2022

(54) COPLANAR BI-FOLD AND SLIDING DOOR

(71) Applicant: Pella Corporation, Pella, IA (US)

(72) Inventors: Todd A. Bernhagen, Pella, IA (US); Nathan R. Erickson, Altoona, IA (US); Paul D. Schroder, Pella, IA (US)

(73) Assignee: Pella Corporation, Pella, IA (US)

( * ) Notice: Subject to any disclaimer, the term of this patent is extended or adjusted under 35 U.S.C. 154(b) by 95 days.

(21) Appl. No.: 16/675,941

(22) Filed: Nov. 6, 2019

(65) Prior Publication Data

US 2021/0131165 A1 May 6, 2021

(51) Int. Cl.

| | |
|---|---|
| ***E06B 3/50*** | (2006.01) |
| ***E05D 15/48*** | (2006.01) |
| ***E05D 15/58*** | (2006.01) |

(52) U.S. Cl.

CPC ..... *E06B 3/5054* (2013.01); *E05D 15/48* (2013.01); *E05D 15/581* (2013.01); *E06B 3/5072* (2013.01); *E05D 2015/485* (2013.01)

(58) Field of Classification Search

CPC ..... E05B 3/5054; E05B 3/5072; E05B 3/509; E05D 15/48; E05D 15/581; E05D 15/507;

(Continued)

(56) References Cited

U.S. PATENT DOCUMENTS 2,317,312 A 4/1943 Swanson et al.
2,680,268 A 6/1954 Rutherford (Continued)

FOREIGN PATENT DOCUMENTS

CA 2969055 A1 6/2016
EP 0605353 A1 * 7/1994 ..... E05D 15/58

(Continued)

OTHER PUBLICATIONS

Hoppe. "Parallel-Retract and Slide," product brochure, available at least as early as Dec. 12, 2017, 2 pages.

(Continued)

*Primary Examiner* — Marcus Menezes
(74) *Attorney, Agent, or Firm* — Faegre Drinker Biddle & Reath LLP

(57) ABSTRACT

A fenestration unit such as a door operable in a sliding mode and a bi-fold folding mode. Examples include a frame, a first panel, a second panel, and one or more fold hinges releasably pivotally connecting a second side portion of the first panel to a first side portion of the second panel and defining a folding axis. In the sliding mode (1) the fold hinges are configured to disconnect the first and second panels, (2) the first panel is in a closed position with respect to the frame, and (3) the second panel is configured to slide along a path generally parallel to the first panel between a closed position and a sliding open position. In the folding mode (1) the fold hinges are configured to pivotally connect the second side portion of the first panel and the first side portion of the second panel, and (2) the first panel and second panel fold with respect to one another about the folding axis with the first panel pivoting with respect to the frame and the second panel sliding and pivoting with respect to the frame as the first and second panels move between the closed positions and folding open positions.

18 Claims, 12 Drawing Sheets

(58) Field of Classification Search
CPC ..... E05D 15/50; E05D 2015/586; E05D 2015/58; E05D 2015/485; E05D 2015/587; E05D 2015/588; E05D 7/10; E06B 3/5054; E06B 3/5072; E06B 3/509
See application file for complete search history.

(56) References Cited

U.S. PATENT DOCUMENTS 4,324,072 A 4/1982 Sterner, Jr.
4,384,429 A 5/1983 Rokicki et al.
4,570,381 A 2/1986 Sterner, Jr.
4,603,452 A * 8/1986 Paciorek ..... E05D 7/10 16/262
5,131,449 A * 7/1992 Winn ..... E05D 15/264 160/199
5,153,034 A 10/1992 Telchuk et al.
5,486,026 A * 1/1996 Borgardt ..... E05B 15/0205 292/71
5,996,282 A 12/1999 Giovannetti
6,052,867 A 4/2000 Haab et al.
6,142,082 A 11/2000 Burke et al.
6,148,896 A 11/2000 Pinto et al.
6,167,936 B1 1/2001 Stover et al.
6,170,207 B1 1/2001 Saindon
6,176,041 B1 1/2001 Roberts
6,216,392 B1 4/2001 DiGinosa
6,238,374 B1 5/2001 Winkler
6,276,092 B1 * 8/2001 Neo ..... E05D 15/0604 49/183
6,336,246 B1 1/2002 Giovannetti
6,374,456 B1 4/2002 Fort et al.
6,405,781 B2 6/2002 Davies et al.
6,446,696 B1 9/2002 Davies et al.
6,454,320 B1 9/2002 Weinerman et al.
6,470,947 B1 10/2002 Holevas
6,497,072 B2 12/2002 Fries
6,618,998 B1 9/2003 Thomas et al.
6,826,867 B1 12/2004 McDonald et al.
6,840,009 B2 1/2005 Ronay et al.
6,860,064 B2 3/2005 Bakalar
6,860,078 B1 3/2005 Geisthardt
6,899,362 B1 5/2005 Weinerman et al.
7,003,916 B2 2/2006 Nestell et al.
7,124,538 B1 10/2006 Kline
7,155,861 B2 1/2007 Berry et al.
7,155,863 B2 1/2007 Daniel et al.
7,219,470 B2 5/2007 Lahnala
7,255,045 B2 8/2007 Owens
7,584,574 B2 9/2009 Kinross et al.
7,610,718 B2 11/2009 Kopish
7,647,728 B2 1/2010 Bortoluzzi
7,647,729 B2 1/2010 Polus
7,673,419 B2 3/2010 Arimoto
D616,566 S 5/2010 Desrosiers et al.
D616,567 S 5/2010 Desrosiers et al.
D616,568 S 5/2010 Desrosiers et al.
7,735,897 B2 6/2010 Seiple et al.
7,819,167 B2 10/2010 Morin
7,934,342 B2 5/2011 Lahnala
7,963,070 B2 6/2011 Recker
7,980,027 B2 7/2011 Kraus et al.
8,112,954 B2 2/2012 Gosling et al.
8,113,607 B2 2/2012 Slager et al.
8,181,394 B2 5/2012 Michaels
8,235,085 B2 8/2012 Coleman et al.
8,297,334 B2 10/2012 Chu
8,375,645 B2 2/2013 Iwauchi et al.
8,375,646 B2 2/2013 Newkirk et al.
8,381,443 B2 * 2/2013 Smith ..... E05D 15/48 49/141
8,381,444 B1 2/2013 McDonald et al.
8,387,309 B2 3/2013 Tseng
8,438,783 B2 5/2013 Giovannetti
8,448,688 B2 5/2013 Goodman et al.
8,479,798 B2 7/2013 Goodman
8,496,038 B2 7/2013 Kondash et al.
8,627,604 B2 * 1/2014 Seymour ..... E05D 15/08 49/141
8,665,582 B2 3/2014 Robinson et al.
8,677,688 B2 3/2014 Skibinski et al.
8,757,238 B2 6/2014 Goodman et al.
8,826,964 B2 9/2014 Goodman
8,905,500 B2 12/2014 Larson et al.
8,919,860 B2 12/2014 Thiele
8,950,114 B1 2/2015 Groening
8,955,195 B2 2/2015 Chang et al.
8,955,260 B2 2/2015 Newkirk et al.
8,960,257 B2 2/2015 Goodman
8,984,810 B2 3/2015 Bortoluzzi et al.
9,027,295 B2 5/2015 Kopish et al.
9,074,420 B2 7/2015 Goodman et al.
9,157,264 B2 10/2015 Bortoluzzi et al.
9,200,860 B1 12/2015 Groening
9,282,831 B2 3/2016 Scibetta et al.
D757,300 S 5/2016 Haberland et al.
9,416,576 B2 8/2016 Andersson et al.
9,447,579 B2 9/2016 Kopish et al.
9,470,028 B2 10/2016 Header et al.
9,637,961 B2 5/2017 Header et al.
9,663,980 B2 5/2017 Bakalar
9,970,232 B2 5/2018 Koenitz
10,077,588 B1 9/2018 Header
10,641,031 B2 5/2020 Koenitz
2001/0037613 A1 * 11/2001 Owens ..... E04B 2/827 52/71
2003/0070363 A1 4/2003 Bakalar
2003/0150165 A1 8/2003 Ronay et al.
2005/0044798 A1 3/2005 Daniel et al.
2006/0225357 A1 10/2006 Bortoluzzi
2007/0062122 A1 3/2007 Polus
2007/0261799 A1 11/2007 Chu
2008/0078216 A1 * 4/2008 Fleming ..... E05C 9/047 70/113
2008/0100093 A1 5/2008 Seiple et al.
2008/0302016 A1 12/2008 Halfon et al.
2008/0302021 A1 12/2008 Gosling et al.
2009/0126279 A1 5/2009 Kopish
2010/0199563 A1 8/2010 Bortoluzzi
2010/0205865 A1 8/2010 Iwauchi et al.
2010/0212233 A1 8/2010 Robinson et al.
2010/0281931 A1 11/2010 Slager et al.
2010/0299871 A1 12/2010 Kondash et al.
2011/0093095 A1 4/2011 Goodman et al.
2011/0126463 A1 6/2011 Skibinski et al.
2011/0185638 A1 8/2011 Giovannetti
2011/0186249 A1 8/2011 Coleman et al.
2012/0005960 A1 1/2012 Tseng
2012/0043865 A1 2/2012 Newkirk et al.
2013/0082582 A1 4/2013 Newkirk et al.
2014/0013685 A1 1/2014 Coleman et al.
2014/0182212 A1 7/2014 Bortoluzzi et al.
2015/0376939 A1 12/2015 Bakalar
2019/0323275 A1 * 10/2019 Stell ..... E06B 3/5072
2019/0338581 A1 * 11/2019 Bernhagen ..... E06B 3/4609
2020/0002986 A1 * 1/2020 Smith ..... E05D 7/10
2020/0217124 A1 7/2020 Bernhagen et al.
2021/0222473 A1 7/2021 Procton et al.
2021/0254394 A1 8/2021 Bernhagen, et al.

FOREIGN PATENT DOCUMENTS

FR 3018306 A1 9/2015
FR 3095224 A1 * 10/2020 ..... E06B 11/022

OTHER PUBLICATIONS

Omnitrack. "9820 Omnitrack High Capacity Ball transfer Unit," Revision 1, Jun. 22, 2012, 1 page. Retrieved from <URL:https://resources.omnitrack.com/files/pdf/9820_2D.pdf>.

* cited by examiner

COPLANAR BI-FOLD AND SLIDING DOOR

FIELD

The present disclosure relates generally to fenestration units. Examples include sliding doors that also fold or pivot between closed and open configurations.

BACKGROUND

Fenestration units such as sliding-type doors are generally known. Doors of these types can include fixed and vent panels mounted to a frame. The fixed panel is fixed within the frame. The vent panel is supported in the frame adjacent to the vent panel when the door is in its closed configuration. The vent panel is slidably mounted to the frame, can be slid to a position generally parallel to the fixed panel to move the door to its open position. Doors with hinged panels that swing between closed and open configuration are also known.

There remains, however, a continuing need for improved fenestration units. For example, there is a need for improved multi-panel doors. Such doors should provide enhanced ingress and egress capabilities. Doors of this type that are structurally robust would be especially desirable.

SUMMARY

Disclosed embodiments include a door and other types of fenestration units operable in a sliding mode and a folding mode. Examples include a frame; a first panel supported by the frame and defined by first and second opposite side portions, wherein the first panel is mounted to enable the first panel to pivot about the first side portion with respect to the frame; a second panel supported by the frame and defined by first and second opposite side portions, wherein the second panel can be mounted to enable the second panel to (1) slide with respect to the frame, and (2) pivot about the second side portion with respect to the frame; and one or more fold hinges configured to releasably pivotally connect the second side portion of the first panel to the first side portion of the second panel and define a folding axis. In the sliding mode (1) the one or more fold hinges are configured to disconnect the first and second panels, (2) the first panel is in a closed position with respect to the frame, and (3) the second panel is configured to slide along a path generally parallel to the first panel between a closed position and a sliding open position. In the folding mode (1) the one or more fold hinges are configured to pivotally connect the second side portion of the first panel and the first side portion of the second panel, and (2) the first panel and second panel fold with respect to one another about the folding axis with the first panel pivoting with respect to the frame and the second panel sliding and pivoting with respect to the frame as the first and second panels move between the closed positions and folding open positions.

In some embodiments of the fenestration unit, each of the one or more fold hinges includes a first mounting portion mounted to one of the second side portion of the first panel or the first side portion of the second panel; and a second mounting portion pivotally connected to the first mounting portion and configured to be connected to and disconnected from the other of the second side portion of the first panel or the first side portion of the second panel.

In various embodiments, each of the one or more fold hinges is mounted to the one of the second side portion of the first panel or the first side portion of the second panel such that the hinge is configured for movement between a retracted position and an extended position. When the fold hinge is in the retracted position, the first mounting portion and the second mounting portion are on the one of the second side portion of the first panel or the first side portion of the second panel to enable operation of the fenestration unit in the sliding mode. When the fold hinge is in the extended position the first mounting portion is on the one of the second side portion of the first panel or the first side portion of the second panel, and the second mounting portion extends from the one of the second side portion of the first panel or the first side portion of the second panel and is configured to be connected to and disconnected from the other of the second side portion of the first panel or the first side portion of the second panel to enable operation of the fenestration unit in the folding mode.

In various embodiments, the one of the second side portion of the first panel or the first side portion of the second panel includes a first recess associated with each of the one or more folding hinges, each first recess configured to receive the first mounting portion and the second mounting portion of the hinge when the hinge is in the retracted position. The other of the second side portion of the first panel or the first side portion of the second panel includes a second recess associated with each of the one or more folding hinges, each second recess configured to receive the second mounting portion of the hinge when the hinge is in the extended position.

In various embodiments, the fenestration unit includes a connector associated with each of the one or more fold hinges. Each connector can be configured to connect the second mounting portion of the hinge to the other of the second side portion of the first panel or the first side portion of the second panel when the hinge is in the extended position.

Various embodiments of the fenestration unit include a latch operable between a latched position and a release position. When in the latched position the latch constrains pivotal motion of the first panel to enable operation of the fenestration unit in the sliding mode. When in the release position the latch enables the first panel to pivot during operation of the fenestration unit in the folding mode.

Various embodiments of the fenestration unit include one or more operable transfer mechanisms operable between a transfer position and a release position. When in the transfer position the transfer mechanism couples the first side portion of the second panel to the frame to enable the second panel to slide with respect to the frame in the sliding mode. When in the release position the transfer mechanism decouples the first side portion of the second panel from the frame to enable the second panel to fold with respect to the first panel in the folding mode.

In various embodiments, the fenestration unit includes one or more fixed transfer mechanisms coupling the second end portion of the second panel to the frame. Each fixed transfer mechanism is configured to (1) enable the second end portion of the second panel to slide with respect to the frame in the sliding mode, and (2) enable the second end portion of the second panel to slide and rotate with respect to the frame in the folding mode.

In various embodiments, the first panel and second panel are coplanar when in the closed positions. Various embodiments include one or more hinges coupling the first side portion of the first panel to the frame to enable the first panel to pivot with respect to the frame.

Other disclosed examples of the fenestration units comprise a frame including a sill, a head, a first jamb, and a second jamb; a first panel including a first rail, a second rail, a first stile and a second stile, wherein the first panel is defined by a first side portion and an opposite second side portion; a pivot connector pivotally coupling the first side portion of the first panel to the frame; one or more latches, each latch operable between a latched position and a release position, wherein each latch is configured to (1) when in the latched position, constrain pivotal motion of the first panel with respect to the frame, and (2) when in the release position, enable the first panel to pivot with respect to the frame; a second panel including a first rail, a second rail, a first stile and a second stile, wherein the second panel is defined by a first side portion and an opposite second side portion; one or more fixed transfer mechanisms, each fixed transfer mechanism pivotally and slidably coupling the second side portion of the second panel to the frame; one or more operable transfer mechanisms, each operable transfer mechanism operable between a transfer position and a release position, wherein each operable transfer mechanism is configured to (1) when in the transfer position, slidably couple the second panel to the frame, and (2) when in the release position, enable the second panel to pivot and slide with respect to the frame; and one or more fold hinges operable between a disconnected state and a connected state to releasably pivotally connect the second side portion of the first panel to the first side portion of the second panel and define a folding axis. When in the sliding mode, each latch can be in the latched position; each fold hinge is in the disconnected state to disconnect the first and second panels; each operable transfer mechanism is in the transfer position; and the first panel is supported with respect to the frame at a first panel closed position, and the second panel is supported with respect to the frame by the one or more operable transfer mechanisms and the one or more fixed transfer mechanisms, configuring the second panel to slide along a path generally parallel to the first panel between a second panel closed position and a second panel sliding open position. When in the folding mode, each latch is in the release position; each fold hinge is in the connected state to pivotally connect the second side portion of the first panel and the first side portion of the second panel; each operable transfer mechanism is in the release position; and the first panel is supported with respect to the frame by the pivot connector and the second panel is supported with respect to the frame by the one or more fixed transfer mechanisms, configuring the first panel and the second panel to fold with respect to one another about the folding axis and extend out of the frame as the first panel pivots with respect to the frame between the first panel closed position and a first panel folding open position and the second panel slides and pivots with respect to the frame between the second panel closed position and a second panel folding open position.

In various embodiments, the pivot connecter includes one or more hinges coupling the first side portion of the first panel to the frame.

In various embodiments, each of the one or more fold hinges includes a first mounting portion mounted to one of the second side portion of the first panel or the first side portion of the second panel; and a second mounting portion pivotally connected to the first mounting portion and configured to be releasably connected to the other of the second side portion of the first panel or the first side portion of the second panel. When in the connected state the second mounting portion is connected to the other of the second side portion of the first panel or the first side portion of the second panel. When in the disconnected state, the second mounting portion is disconnected from the other of the second side portion of the first panel or the first side portion of the second panel.

In various embodiments, each of the one or more fold hinges is mounted to the one of the second side portion of the first panel or the first side portion of the second panel such that the hinge is operable between a retracted position and an extended position. When in the retracted position and disconnected state, the first mounting portion and the second mounting portion are on the one of the second side portion of the first panel or the first side portion of the second panel. When in the extended position and connected state, the first mounting portion is on the one of the second side portion of the first panel or the first side portion of the second panel, and the second mounting portion extends from the one of the second side portion of the first panel or the first side portion of the second panel and is connected to the other of the second side portion of the first panel or the first side portion of the second panel.

In various embodiments the one of the second side portion of the first panel or the first side portion of the second panel includes a first recess associated with each of the one or more folding hinges. Each first recess is configured to receive the first mounting portion and the second mounting portion of the hinge when the hinge is in the retracted position. The other of the second side portion of the first panel or the first side portion of the second panel includes a second recess associated with each of the one or more folding hinges. Each second recess is configured to receive the second mounting portion of the hinge when the hinge is in the extended position.

Various embodiments include a connector associated with each of the one or more fold hinges. Each connector can be configured to (1) connect the second mounting portion of the hinge to the other of the second side portion of the first panel or the first side portion of the second panel when the hinge is in the extended position and connected state, and (2) disconnect the second mounting portion of the hinge from the other of the second side portion of the first panel or the first side portion of the second panel when the hinge is in the retracted position and disconnected state.

Disclosed embodiments also include a method for operating a fenestration unit including a first panel having first and second opposite side portions, a second panel having first and second opposite side portions, and a frame supporting the first panel and second panel, wherein when the fenestration unit is in a closed configuration the first panel is in a first panel closed position and the second panel is in a second panel closed position. The fenestration unit can be operated in a sliding mode to transition the fenestration unit to a sliding open configuration by causing the first panel to remain in the first panel closed position; causing the second side portion of the first panel to be disconnected from the first side portion of the second panel; causing the second panel to be slidable with respect to the frame about a path generally parallel to the first panel; and sliding the second panel about the path between the second panel closed position and a second panel sliding open position. The fenestration unit can be operated in a folding mode to transition the fenestration unit to a folding open configuration by causing the second side portion of the first panel to be released from the frame to enable pivoting of the first panel about the first side portion with respect to the frame; causing the second side portion of the first panel to be pivotally connected to the first side portion of the second panel about a folding axis; causing the first side portion of the second panel to be released from the frame and enabling pivoting and sliding of the second panel about the second side portion with respect to the frame about the path; and folding the first panel and the second panel about the folding axis with the second side portion of the first panel and the first side portion of the second panel extending from the frame as the first panel pivots with respect to the frame and moves between the first panel closed position and a first panel folding open position and the second side portion of the second panel slides along the path and pivots with respect to the frame as the second panel moves between the second panel closed position and a second panel folding open position.

In various embodiments, operating the fenestration unit in the sliding mode includes causing a releasable latch to be in a latched position coupling the second side portion of the first panel to the frame to cause the first panel to remain in the first panel closed position; causing a fold hinge to be in a disconnected state to cause the second side portion of the first panel to be disconnected from the first side portion of the second panel; and causing an operable transfer mechanism to be in a transfer position coupling the first side portion of the second panel to the frame to enable the second panel to be slidable about the path. Operating the fenestration unit in the folding mode includes causing the releasable latch to be in a release position uncoupling the second side portion of the first panel from the frame; causing the fold hinge to be in a connected state to cause the second side portion of the first panel to be pivotally connected to the first side portion of the second panel; and causing the operable transfer mechanism to be in a release position uncoupling the first side portion of the second panel from the frame.

DETAILED DESCRIPTION

Figure 1:
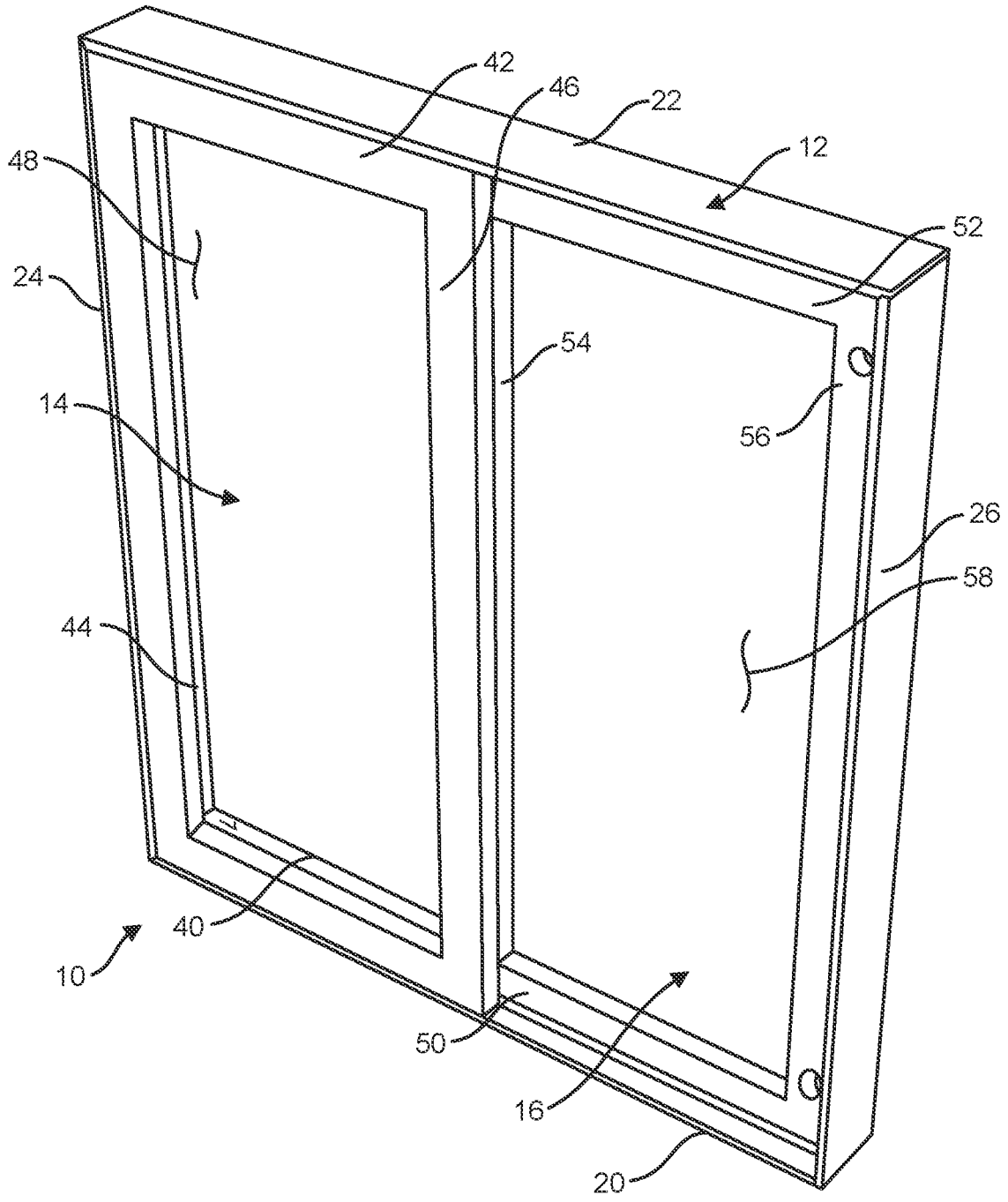
FIG. 1 is an isometric view of a fenestration unit in the form of a door in accordance with embodiments, shown in a closed configuration.

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale, and may be exaggerated to illustrate various aspects of the present disclosure, and in that regard, the drawing figures should not be construed as limiting. Moreover, while embodiments including two movable panels are disclosed herein, other embodiments including a fenestration unit having more than two movable panels, and in addition no, one or more than one fixed panels, are also contemplated.

Various aspects of the present disclosure are directed toward fenestration units that are adapted to provide for versatility in how they may be opened. Fenestration units according to the present disclosure may be adapted for sliding doors, sliding windows, and any other fenestration unit having one or more sliding panels. An exemplary fenestration unit 10 in the form of a door 10 is illustrated in FIG. 1. As shown, the door 10 includes a frame 12 and a plurality of panels, such as first panel 14 and second panel 16. The door 10 is configured to define a boundary between an interior space and an exterior space, such as an interior space of a home and the elements outside of the home for example, while providing access through an opening in the fenestration unit between the interior and exterior spaces. As described in greater detail below, door 10 is configured for operation in either or both of a first or sliding mode, or a second or folding mode, to provide the access between the interior and exterior spaces.

Figure 2:
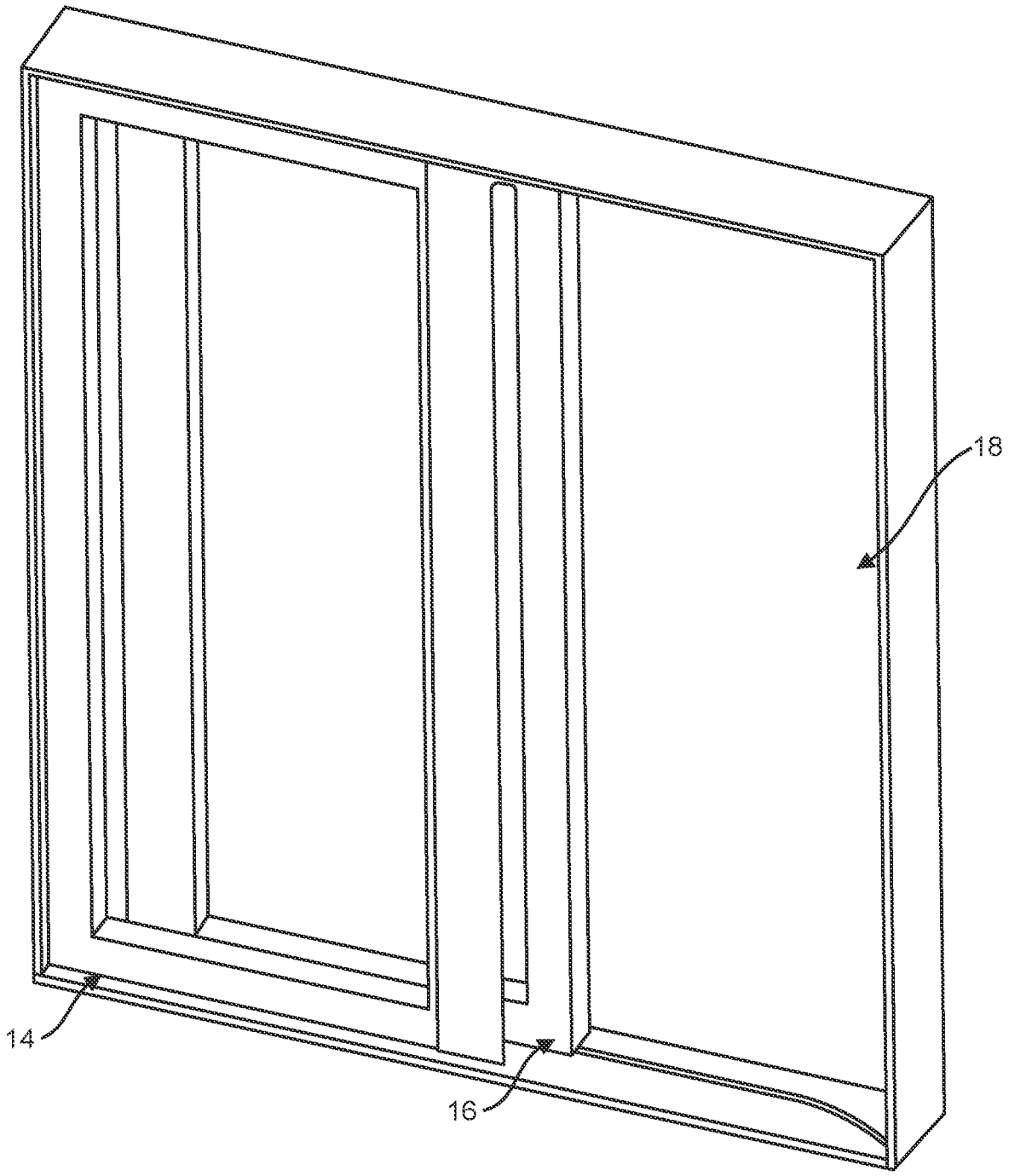
FIG. 2 is an isometric view of a door such as that illustrated in FIG. 1, shown in a sliding open configuration.
Figure 3:
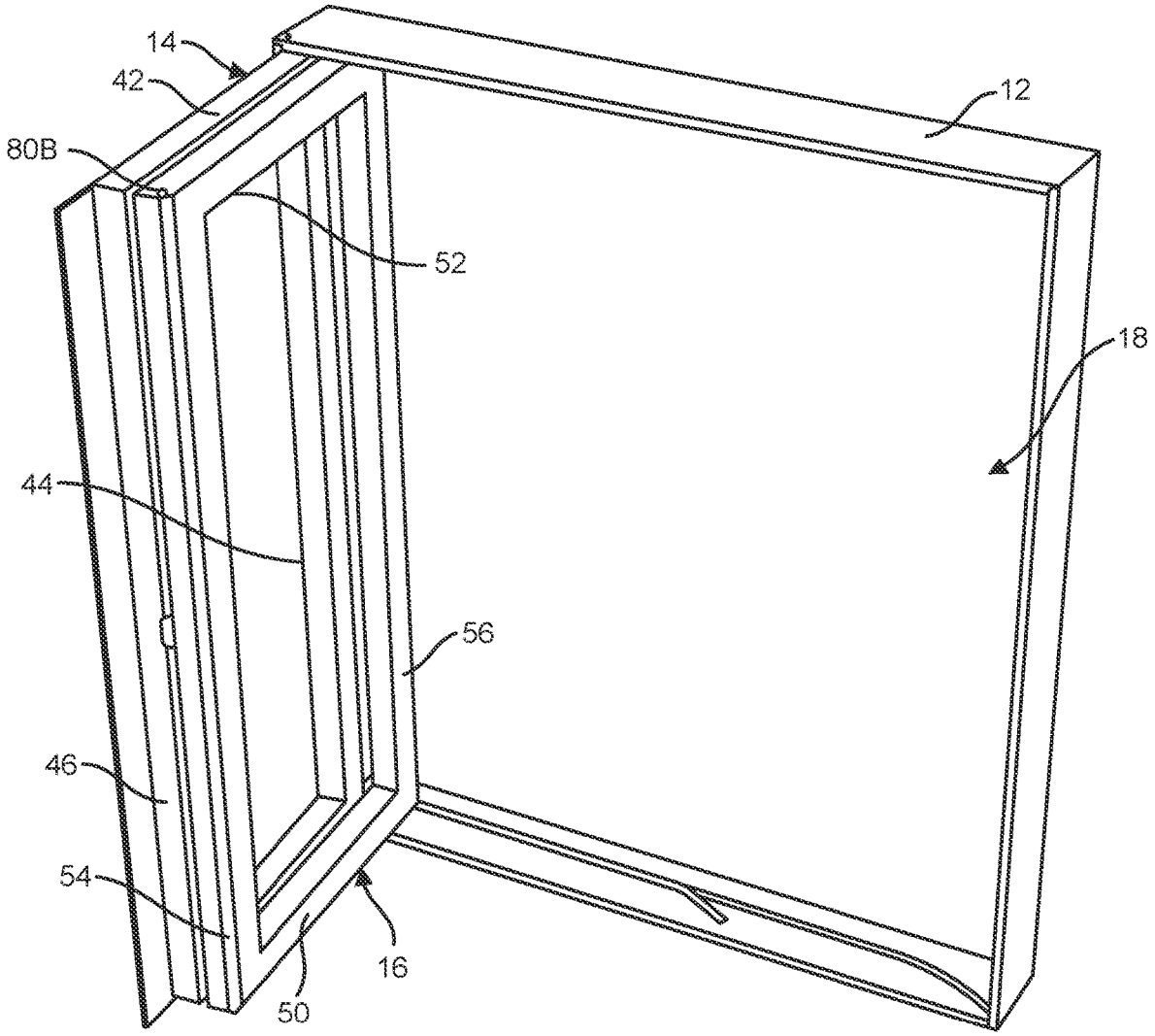
FIG. 3 is an isometric view of a door such as that illustrated in FIG. 1, shown in a folding open configuration.

As shown in FIG. 1, the first panel 14 and the second panel 16 are both situated within and supported by the frame 12. In various embodiments, the second panel 16 is configured to slide relative to the frame 12 to provide an opening in the door 10 during the sliding operating mode. For example, as shown in FIG. 2, the door 10 is shown in a partially open configuration where the second panel 16 has been slid partially open to define a partial frame opening 18. The first panel 14 is configured to be pivoted relative to the frame 12, and the second panel 16 is configured to be pivoted and to slide relative to the frame, such that the first and second panels can be hinged, folded or otherwise pivoted and slid open to increase the size of the opening in the door 10 during the folding operating mode. For example, as shown in FIG. 3, each of the first and second panels 14 and 16 are shown folded open or otherwise pivoted and slid open relative to the frame 12 to define a relatively full frame opening 18. It is to be appreciated that the first and second panels 14 and 16 can be configured to fold or pivot outwardly toward an exterior and/or inwardly toward an interior.

Thus, in various examples, the door 10 may include a plurality of panels such as 14 and 16, where both of the panels are configured to slide and/or pivot relative to the frame 12 of the door. Such a configuration provides for a door 10 that is adapted for providing a relatively large opening in comparison to conventional doors having sliding panels. Such a configuration also provides for a door 10 having one or more panels such as 14 and 16 that can slide (e.g., to provide an opening where pivoting the same to provide for a larger opening is unnecessary). Doors or other fenestration units in accordance with these examples provide enhanced ingress and egress capabilities. They are also structurally robust.

With continued reference to the embodiment shown in FIG. 1, the frame 12 of the door 10 includes a sill 20, a head 22, a first jamb 24, and a second jamb 26. The sill 20 is a structural frame element that generally defines a bottom portion of the frame 12, while the head 22 is a structural frame element that generally defines a top portion of the frame. The sill 20 and the head 22 each generally extend laterally between the first and second jambs 24 and 26, as shown. The first and second jambs 24 and 26 are structural frame elements that extend vertically between the sill 20 and the head 22. In various examples, the head 22 is supported by each of the first and second jambs 24 and 26. The first jamb 24 generally defines a first side portion of the frame 12, while the second jamb 26 is situated opposite the first jamb and generally defines a second side portion of the frame.

Figure 4A:
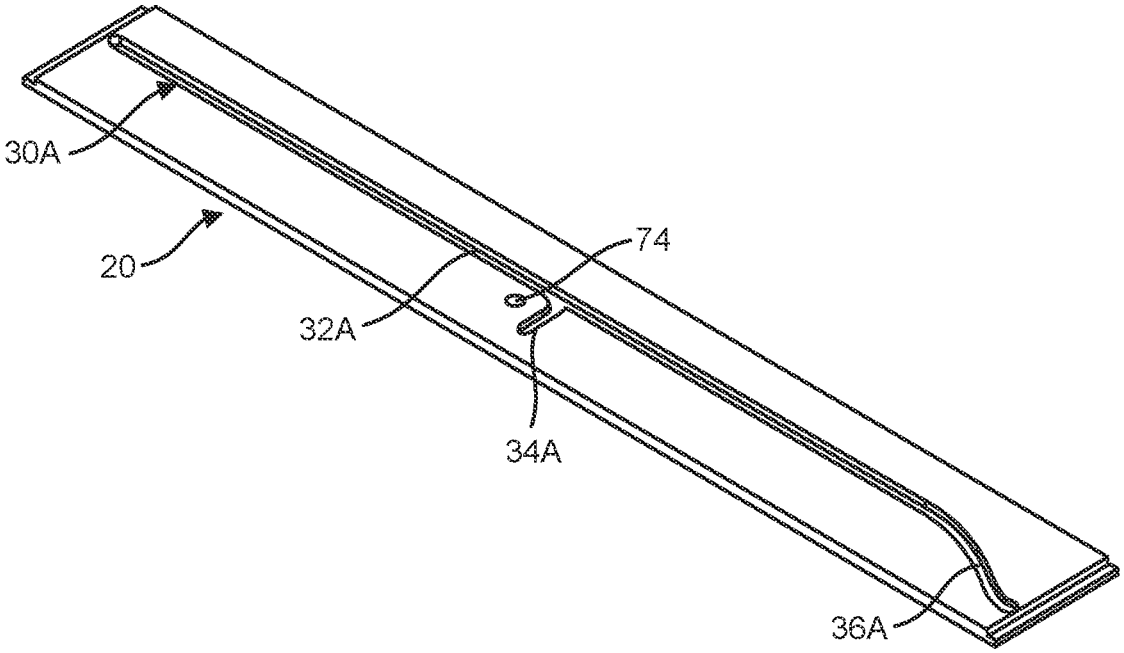
FIG. 4A is an isometric view of a sill of a door such as that illustrated in FIG. 1.
Figure 4B:
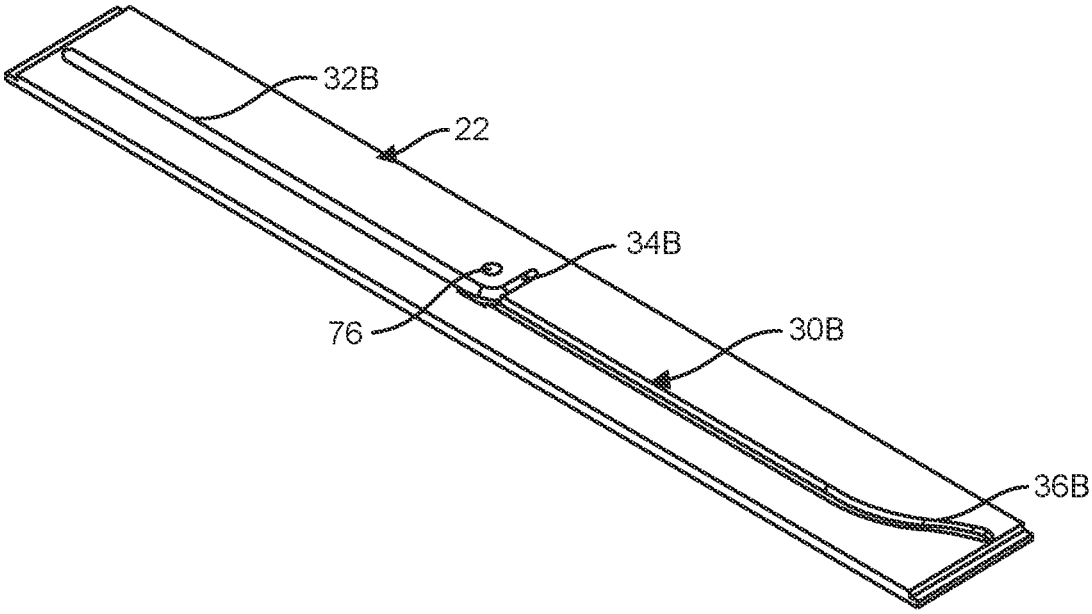
FIG. 4B is an isometric view of a head of a door such as that illustrated in FIG. 1.

FIGS. 4A and 4B illustrate the interior or panel-facing sides of the sill 20 and head 22, respectively. As shown, the sill 20 and head 22 include tracks 30A and 30B, respectively, that guide the second panel 16 along paths between closed and open positions. Tracks 30A and 30B include first portions 32A and 32B, respectively, that define generally linear paths extending between the first and second jambs 24, 26 (i.e., in a direction generally parallel to the major planar surfaces of the first and second panels 14, 16). In various embodiments, and as shown for example in FIG. 1, the second panel 16 of door 10 can be coplanar with the first panel 14 of the door when the first and second panels are in closed positions (e.g., the angle between the first and second panels can be 10 degrees or less). In embodiments with this coplanar closed configuration feature of door 10, and as described in greater detail below, tracks 30A and 30B can include second portions 34A and 34B and third portions 36A and 36B, which extend from the first portions 32A and 32B, respectively, in generally transverse directions. As described in greater detail below, the first portions 32A and 32B of tracks 30A and 30B, respectively, are configured to facilitate lateral and sliding translation of the second panel 16, and to guide the second panel along a path generally parallel and adjacent to the first panel 14 as the second panel moves between its closed and open positions. Second portions 34A and 34B and third portions 36A and 36B of tracks 30A and 30B, respectively, are configured to facilitate generally transverse motion of the second panel 16 when the panel is near its closed position, and to guide the second panel to and from its closed position coplanar with the first panel 14. The tracks 30A and 30B are configured to receive one or more components of the second panel 16, such as one or more wheels, pins, bolts, riders, roller bearings (e.g., unidirectional, multidirectional, and/or omnidirectional) or other transfer mechanisms to facilitate this movement. In some examples, the tracks 30A and 30B are formed as grooves in the sill 20 and head 22, respectively. In some examples, the tracks 30A and 30B are formed as concave grooves configured to accommodate convex riders (e.g., such as convex wheels and/or rollers). In other examples the tracks 30A and 30B are formed as convex protrusions configured complementary to concave riders (e.g., such as concave wheels). In other embodiments (not shown), second panel 16 is parallel to but not coplanar with the first panel 14 when the second panel is in its closed position, and the tracks need not include the second portions 34A, 34B and third portions 36A, 36B or other structures to accommodate the coplanar feature. In some examples, one or more of the tracks 30A, 30B extend the entire width of the sill 20 and head 22, respectively, such as from the first jamb 24 to the second jamb 26. In some examples, the one or more tracks 30A, 30B extend along only a portion of less than all of the sill 20 and head 22, respectively.

Referring back to FIG. 1, the illustrated embodiment of the first panel 14 includes a first rail 40, a second rail 42, a first stile 44 and a second stile 46. The first rail 40 is a structural element that generally defines a bottom portion of the panel 14, while the second rail 42 is a structural element that generally defines a top portion of the panel. The first rail 40 and second rail 42 each generally extend laterally between the first and second stiles 44 and 46, as shown. The first and second stiles 44 and 46 are structural elements that extend vertically between the first rail 40 and the second rail 42. The first stile 44 generally defines a first side portion of the panel 14, while the second stile 46 is situated opposite the first stile and generally defines a second side portion of the panel 14. In the illustrated embodiment, the first rail 40, second rail 42, first stile 44 and second stile 46 form a frame that supports a glass or other panel 48.

Second panel 16, similar to first panel 14, includes a first rail 50, a second rail 52, a first stile 54, a second stile 56 and a glass or other material panel 58. The first rail 50, second rail 52, first stile 54 and second stile 56 of second panel 16 are configured and function in manners that are the same as or similar to the corresponding components of the first panel 14. For example, the first stile 54 of the second panel 16 generally defines a first side portion of the panel, and the second stile 56 generally defines a second side portion of the second panel.

In some examples, when the door 10 is in the closed configuration, the opening of frame 12, which is the region defined between the sill 20, the head 22, and the first and second jambs 24 and 26, is at least substantially blocked or otherwise obstructed by the first and second panels 14 and 16, as those of skill will appreciate. As such, when in the closed configuration, the door 10 operates to separate the exterior space and the interior space. It is to be appreciated that while fenestration units such as door 10 described herein are referred to in conjunction with an interior and an exterior space, the fenestration units may be configured to separate first and second rooms or other areas of a structure. When the illustrated embodiment of door 10 is in the closed configuration, the first stile 44 of the first panel 14 is proximate (e.g., in or close to actual contact with) the first jamb 24 of the frame 12. Additionally, the second stile 56 of the second panel 16 is proximate (e.g., in or close to actual contact with) the second jamb 26. Additionally, as shown, the second stile 46 of the first panel 14 is proximate (e.g., in or close to actual contact with) the first stile 54 of the second panel 16 when the door is in the closed configuration.

Figure 5:
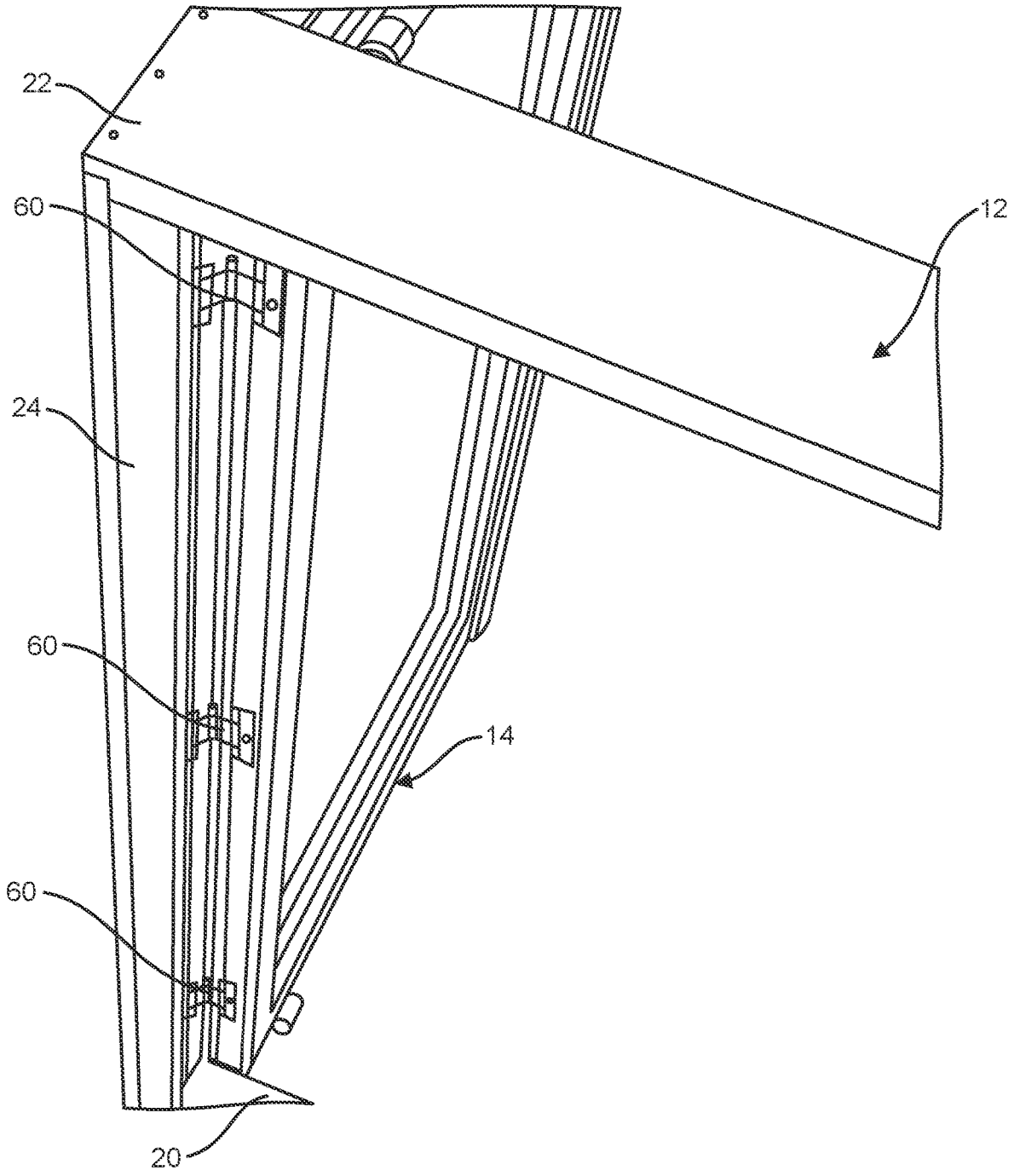
FIG. 5 is an isometric view of a portion of a door such as that illustrated in FIG. 1, showing a first panel of the door in an open position.

The first panel 14 is mounted to the frame 12 for rotation or pivotal motion about the second side portion of the first panel with respect to the frame. In various embodiments, the first stile 44 of the first panel 14 is hingedly coupled to the first jamb 24 of the frame 12 to provide this functionality. In the example illustrated in FIG. 5, the door 10 includes one or more pivot assemblies, such as one or more hinges 60, which are coupled with the first stile 44 and configured to pivotally couple the first panel 14 to the first jamb 24 of the frame 12. In the illustrated example, the one or more hinges 60 are positioned along the height of the first jamb 24 from the sill 20 to the head 22. While the pivot assemblies are shown in FIG. 5 as hinges, it will be appreciated that any of a variety of actuation mechanisms, including pivot bolts, may be utilized to facilitate actuation of the first panel 14 relative to the frame 12. In other embodiments, the first panel 14 is configured for rotation with respect to the frame 12 by other approaches and structures. For example, pivot pin assemblies can couple the first and second rails 40 and 42 and/or top and bottom portions of the first stile 44 of the first panel 14 to the sill 20 and head 22 of the frame 12, respectively.

Figure 6:
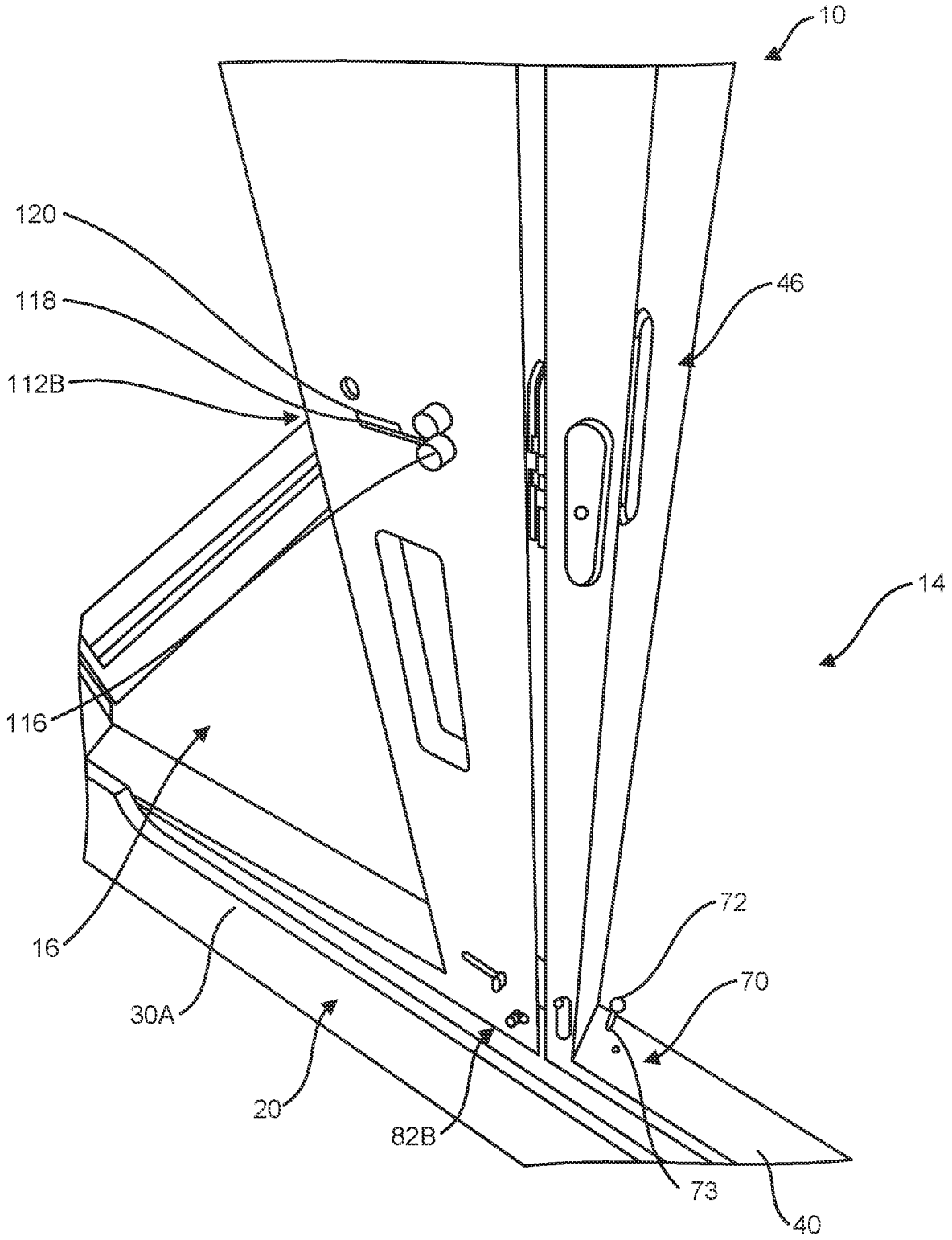
FIG. 6 is a detailed isometric view of a portion of a door such as that illustrated in FIG. 1, showing the door in a closed configuration.

FIG. 6 illustrates the door 10 in the closed configuration with both the first panel 14 and the second panel 16 in closed positions. FIG. 6 also illustrates a lock or latch 70 of the first panel 14 in accordance with examples. The latch 70 is coupled with the first panel 14, and is generally configured to interface with the sill 20 of frame 12 such that the first panel can be selectively transitioned between a fully constrained configuration (e.g., when in a closed position) and a partially constrained configuration (e.g., when in an open position). In various examples, in the fully constrained configuration, the first panel 14 is coupled with the frame 12 such that the first panel is constrained against translation and rotation relative to the frame 12. In the partially constrained configuration, the first panel 14 is operable to be pivoted relative to the frame 12. The latch 70 is therefore configured to provide users with the ability to selectively decouple a portion of the first panel 14 from the frame 12 such that the first panel can be pivoted open relative to the frame. In some examples, as discussed further below, the first panel 14 can be selectively decoupled from the frame 12 at or proximate the second stile 46 (i.e., the second side portion of the first panel) such that the first panel is free to pivot relative to the frame, such as about the hinges 60.

In various embodiments, the latch 70 includes a pin 72 mounted in an aperture 73 on the first rail 40 adjacent to the second stile 46. In various examples, the pin 72 is operable for actuation between a latched or engaged position, and a release or disengaged position. When the first panel 14 is in the closed position and the latch 70 in in the latched position, the pin 72 extends through the aperture 73 in the first rail 40 and into an opening 74 in the sill 20 of the frame 12 such that the first panel 14 is fully constrained by the frame 12. FIG. 4A illustrates an example of the opening 74 in the sill 20. In other embodiments, (not shown), the opening 74 can be a structure in a strike plate on the sill 20. When the latch 70 is in the release position, the pin 72 is withdrawn from the opening 74 in the sill 20 such that the first panel 14 is operable to be pivoted relative to the frame 12. Other embodiments of door 10 have other configurations of latches or structures to releasably couple the first panel 14 to the frame 12. Although the latch 70 is shown on the rail 40 at the second side portion of the panel 14 in the illustrated embodiment, the latch is positioned at other locations in other examples. For example, the latch 70 can be located on the frame 12, first jamb 24, or at other positions on the first rail 40. Various embodiments can include one or more additional latches such as 70 on the first rail 40, and/or on the second rail 42 to releasably engage the head 22 of the frame 12. Any such additional latches can operate in a manner that is similar to or the same as the latch 70 described above. FIG. 4B illustrates an opening 76 in the head 22 that can be engaged by the pin of such an additional latch on the second rail 42 (not shown).

Figure 7:
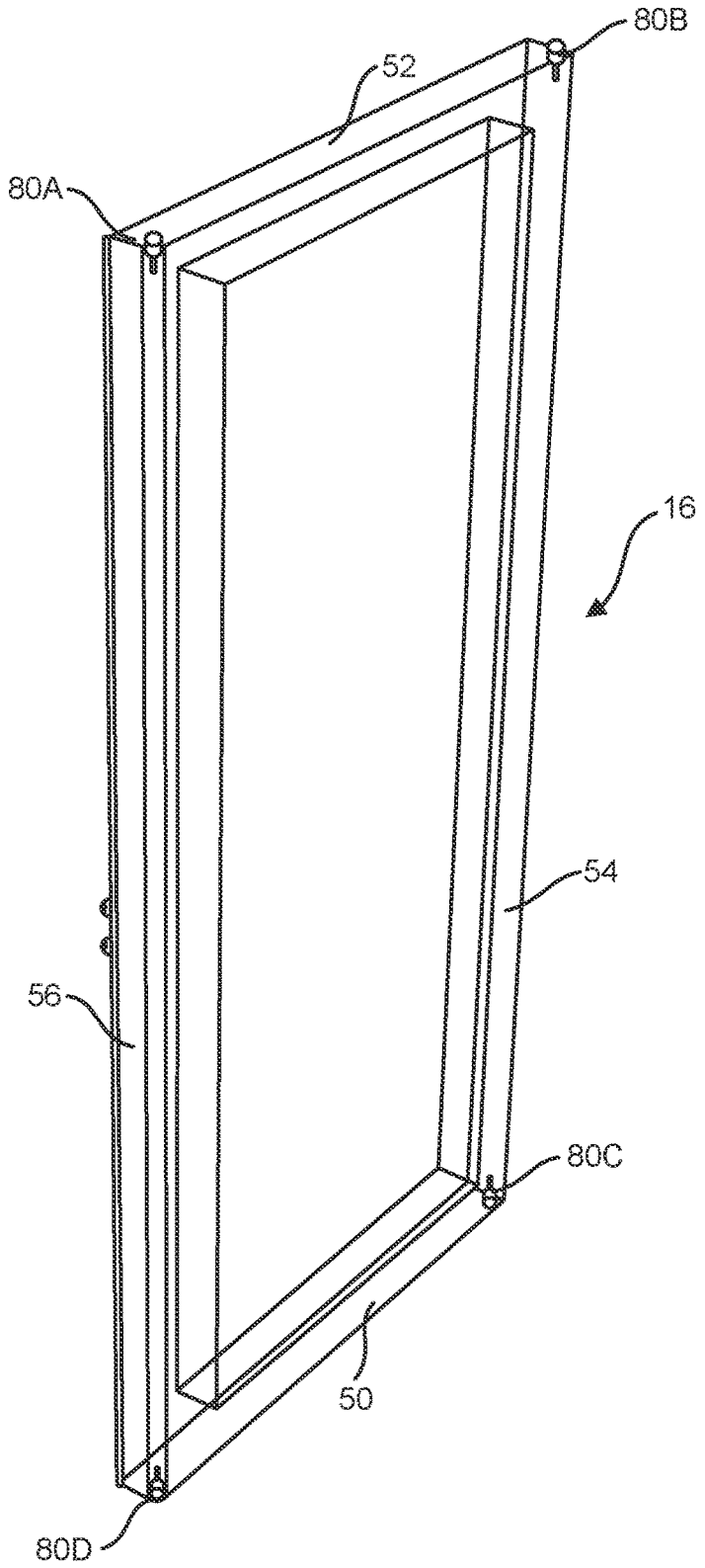
FIG. 7 is a detailed isometric view of a first panel of a door such as that illustrated in FIG. 1.

Second panel 16 is configured to translate by sliding and pivoting with respect to the frame 12. In various embodiments such as those shown in FIG. 7, the second panel 16 includes a plurality of transfer mechanisms, such as for example riders 80A, 80B, 80C and 80D, to provide the sliding and pivotal translation functionality. As shown, riders 80A and 80B are situated opposite one another along a top of the second panel 16. The rider 80A, for example, may be situated at a top of the second stile 56 or may be situated along the top rail 52 proximate the second stile. Similarly, the rider 80B may be situated at a top of the first stile 54 or may be situated along the top rail 52 proximate the first stile in examples. Similarly, riders 80C and 80D are situated opposite one another along a bottom of the second panel 16. The rider 80C, for example, may be situated at a bottom of the first stile 54 or may be situated along the bottom rail 50 proximate the first stile. The rider 80D, for example, may be situated at a bottom of the second stile 56 or may be situated along the bottom rail 50 proximate the second stile.

In some examples, as discussed further below, the plurality of riders 80A-80D are operable to slide and/or pivot within the plurality of tracks 30A and 30B of the frame 12, and thus operate to facilitate translation of the second panel 16 within the frame 12. In some examples, one or more of the plurality of riders 80A-80D are operable such that they can be actuated between release or retracted states or positions, and transfer or extended states or positions. As explained further below, by such a configuration one or more of the plurality of riders 80A-80D are operable to be retracted. When the one or more riders 80A-80D are retracted, the second panel 16 can be at least partially decoupled from the tracks 30A and 30B of the frame 12 and thereby enabled to slide and pivot relative to the frame 12.

Figure 8:
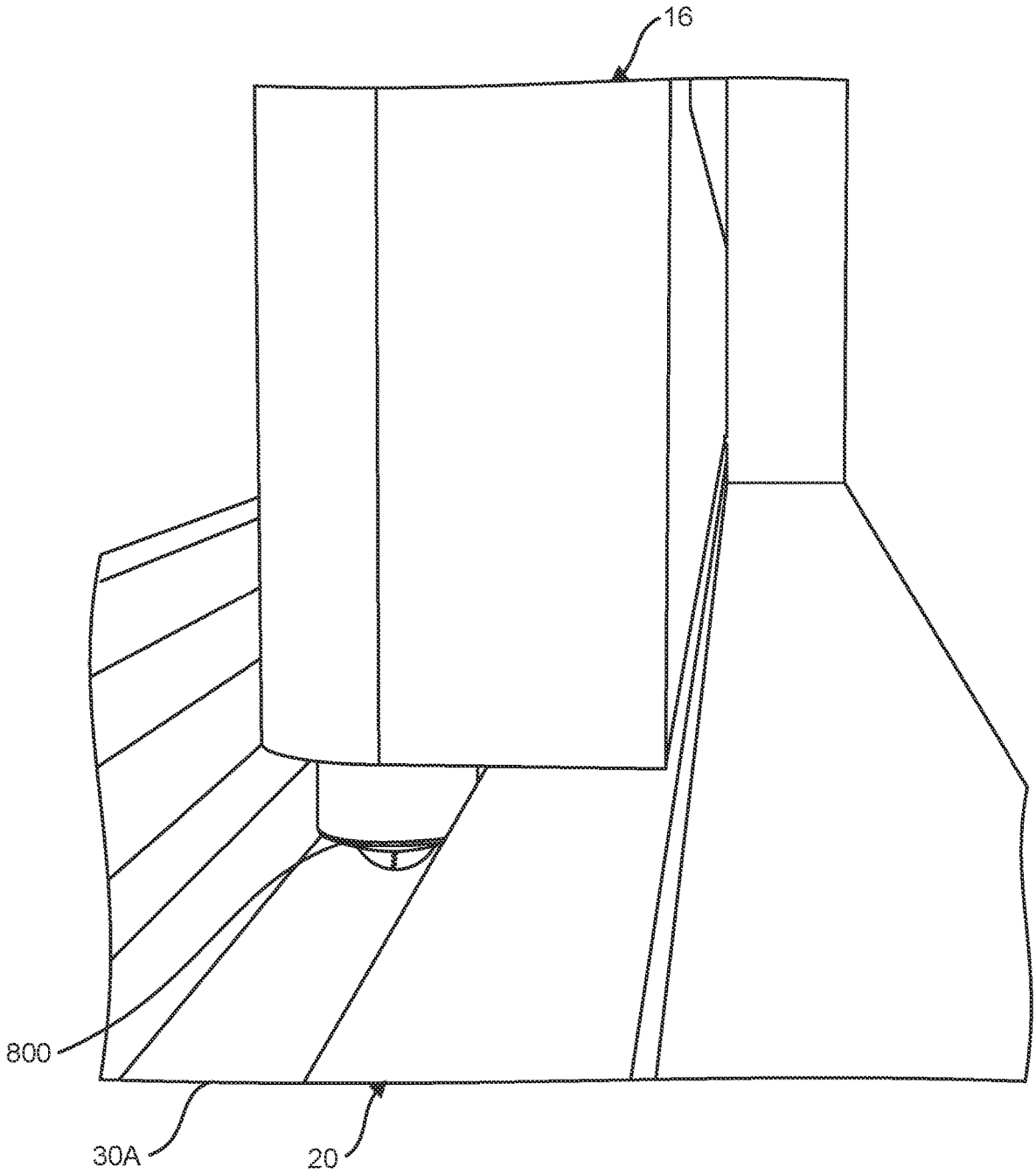
FIG. 8 is a detailed isometric view of a portion of a door such as that illustrated in FIG. 1, showing the second panel and sill.

As mentioned above, in various examples, the plurality of riders 80A-80D are configured to be received by one or more tracks 30A and 30B of the frame 12. FIG. 8 shows the sill 20 of the door 10 with the rider 80D of the second panel 16 received within the track 30A of the sill. Each of the plurality of riders 80A-80D is optionally similar, or may differ as desired. In various embodiments, one or more of the plurality of riders 80A-80D include a bearing, a wheel, a pin, a bolt, a unidirectional roller bearing, a multi-directional roller bearing, and/or an omnidirectional roller bearing.

Figure 9:
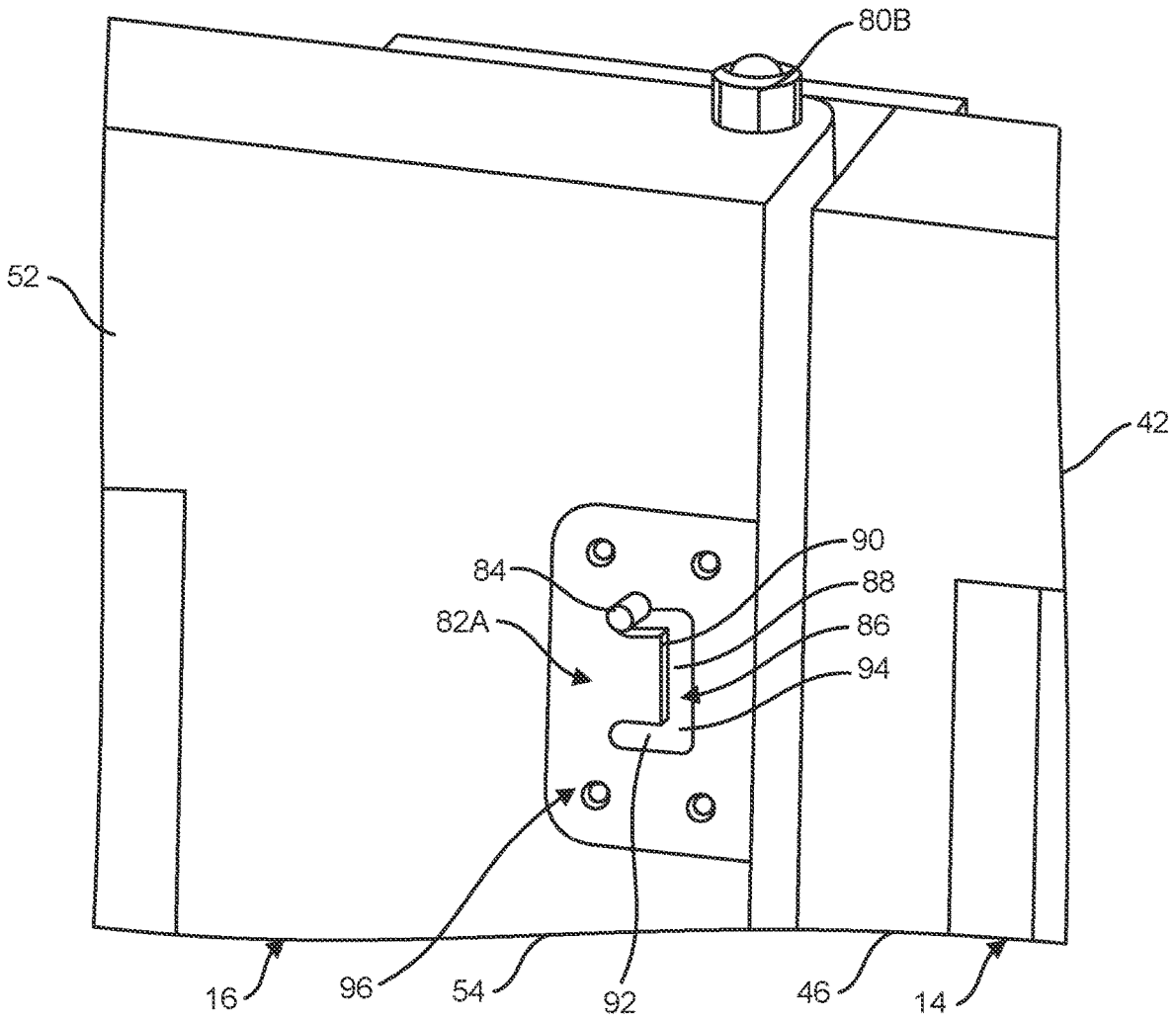
FIG. 9 is a detailed isometric view of a portion of a door such as that illustrated in FIG. 1, showing a retraction assembly to actuate a transfer mechanism such as a rider.
Figure 11:
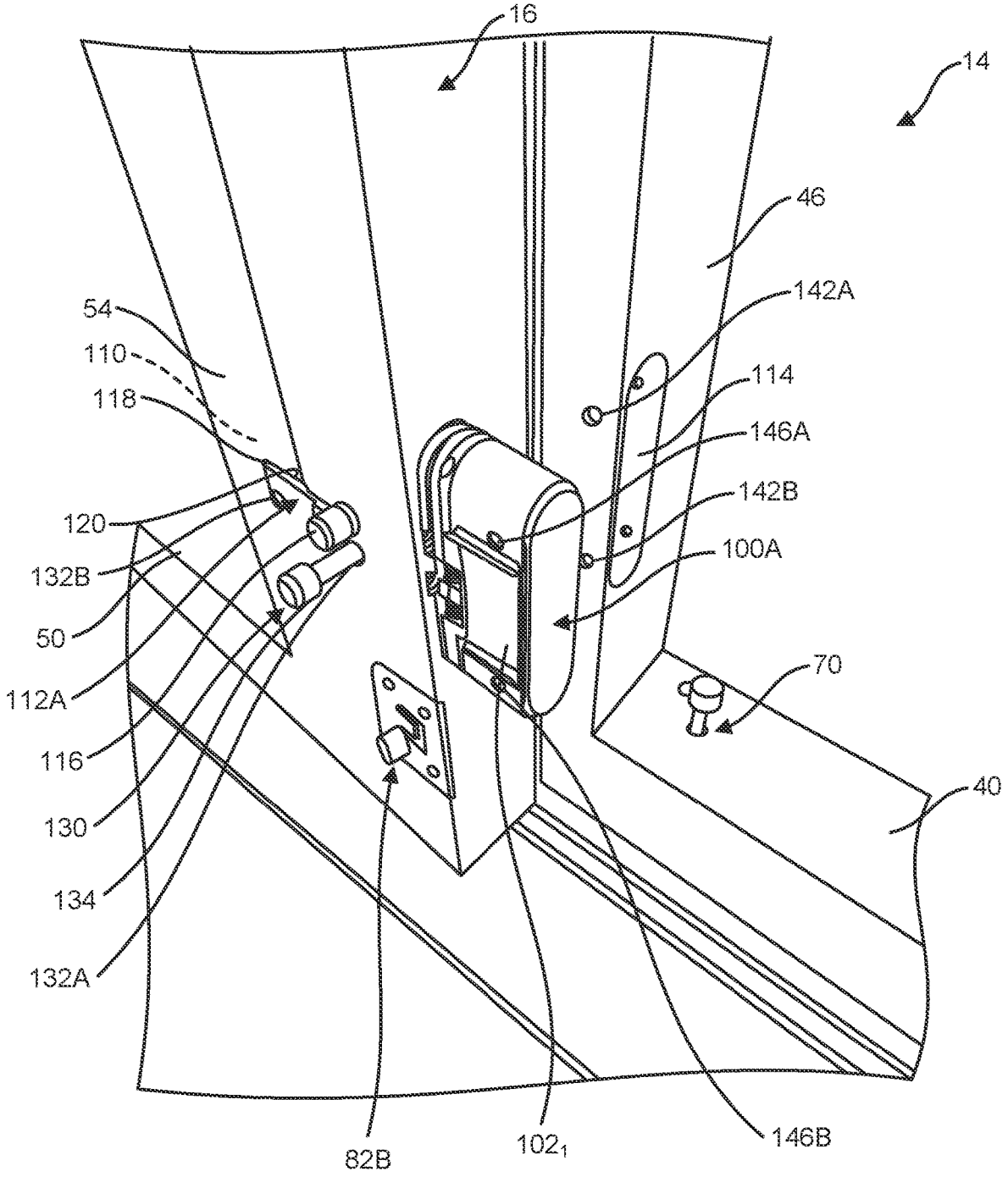
FIG. 11 is a detailed isometric view of a portion of a door such as that illustrated in FIG. 1, showing a hinge assembly.

In various embodiments, riders 80B and 80C are substantially similar and thus are described collectively with regard to rider 80B. In particular, riders 80B and 80C are operable and configured such that they are retractable on the second panel 16. As such, riders 80B and 80C can be retracted to partially decouple the second panel 16 from the frame 12 such that the second panel can be translated and pivoted relative to the frame 12. FIG. 9 shows rider 80B extending from the second panel 16, where the second panel includes a first retraction assembly 82A operably coupled to the rider 80B such that the rider can be extended and retracted relative to the frame 12, according to some examples. A second retraction assembly 82B shown in FIGS. 6 and 11 is substantially the same as or similar to the first retraction assembly 82A, and is coupled to rider 80C in a substantially similar manner to how the first retraction assembly 82A is coupled to rider 80B.

As shown in FIG. 9, the first retraction assembly 82A includes a rider control member 84, which is operably coupled to rider 80B such that the rider control member can be actuated (e.g., by a user) to cause the rider to transition between a first extended or transfer position (e.g., as shown in FIG. 9) and a second retracted or release position. Rider 80B is shown in the retracted or release position in FIG. 1, and it is to be appreciated that rider 80C is similarly configured when transitioned to the retracted or release position. In various embodiments, the rider control member 84 is slideably received in a rider control cutout 86. The rider control cutout 86 defines a path 88 that is traversable by the rider control member 84. The path 88 of the rider control cutout 86 is shown in FIG. 9 as being a reverse "C" shape, although other paths are contemplated. Accordingly, the illustrated example shown in FIG. 9 is not intended to be limiting, but may include any suitable path operable to be traversed by the rider control member 84 to cause the rider 80B to be transitioned between the extended or transfer positions and retracted or release positions. In some examples, the path 88 includes a first portion 90 associated with the rider 80B being in the extended position, and a second portion 92 associated with the rider being in the retracted position. In the illustrated example shown in FIG. 9, the path 88 includes a transition portion 94 linking the first and second portions 90 and 92. As shown, the first and second portions 90 and 92 are angled relative to the transition portion 94. It is to be appreciated that while the first and second portions 90 and 92 extend substantially perpendicular to the transition portion 94, the first and second portions may not be angled relative to the transition portion, or may alternatively be angled relative to the transition portion at any suitable angle, provided that the rider 80B is selectively securable at each of the extended and retracted positions. The rider control cutout 86 may be formed directly in the second panel 16 (e.g., such as in the first stile 54), or may alternatively be formed in a separate housing 96 that is received by and/or secured to the second panel. A linkage member (not visible) can couple the rider control member 84 to the rider 80B to couple the motion of the rider control member to the rider.

In various embodiments, rider 80B is configured to slidably couple the second panel 16 to the head 22 of frame 12 proximate the first stile 54 (e.g., the first side portion of the second panel) when the rider is in the extended or transfer position. In various embodiments, for example, the rider 80B can extend into and be guided for motion by the track 30B in the head 22. Conversely, when the rider 80B is in the retracted or release position, the rider is decoupled from the head 22 and frame 12 such that the second panel 16 is decoupled from the head proximate the first stile 54 (e.g., the first side portion of the second panel). Similarly, rider 80C is configured to slidably couple the second panel 16 to the sill 20 of frame 12 (e.g., via track 30A) proximate the first stile 54 when the rider 80C is in the extended position. Similarly, when the rider 80C is in the retracted position, the rider 80C is decoupled from the sill 20 such that the second panel 16 is decoupled from the sill proximate the first stile 54.

With the riders 80B and 80C in the retracted positions, the second panel 16 is decoupled from the frame 12 (e.g., the sill 20 and the head 22) proximate the first stile 54, such that the second panel can slide and pivot relative to the frame via riders 80A and 80D. FIG. 3, for example, shows the second panel 16 in a pivoted-open position as a result of the second panel being decoupled from the frame 12 proximate the first stile 54. As shown, the second panel 16 is slid from its closed position and pivoted about the second stile 56. In various examples, the second panel 16 is slid and pivoted about the riders 80A and 80D, which are configured to remain coupled with the frame 12 (e.g., the sill 20 via track 30A and the head 22 via the track 30B) while the riders 80B and 80C are decoupled from the frame.

FIGS. 6 and 10-12 illustrate hinges 100A-100C connecting the first panel 14 and the second panel 16 in accordance with embodiments. Although three hinges 100A-100C are shown and described with reference to the illustrated examples, other embodiments include more or fewer hinges. The hinges 100A-100C are configured to be operable between disengaged or disconnected states or positions, and engaged or connected states or positions, and to thereby releasably pivotally connect the first panel 14 and second panel 16. As described in greater detail below, when in the disconnected states, the hinges 100A-100C disconnect the first panel 14 from the second panel 16, enabling the first and second panels to move independently of one another. When in the connected states, the hinges 100A-100C pivotally connect the first panel 14 and second panel 16, enabling the first and second panels to pivot with respect to one another about a folding axis defined by the hinges.

In various embodiments, each of the hinges 100A-100C includes a first mount 1021 and a second mount 1022, a first set of leaves 1041 extending from the first mount 1021, a second set of leaves 1042 extending from the second mount 1022 (two leaves extend from each mount in the illustrated embodiment), and a pivot pin 106. The leaves 1041 and 1042 extend from their respective mounts 1021 and 1022 toward each other and into interleaved and overlapping positions. Pivot pin 106 extends through the interleaved leaves 1041 and 1042 and defines a pivot axis. The first mount 1021 and second mount 1022 pivot or rotate with respect to one another about the pivot axis defined by the pivot pin 106.

Hinges 100A-100C releasably connect the second side portion of the first panel 14 to the first side portion of the second panel 16. In the illustrated embodiments, for example, when the hinges 100A-100C are in the connected states, the first mounts 1021 are coupled to the second stile 46 of the first panel 14, and the second mounts 1022 are coupled to the first stile 54 of the second panel 16. In various embodiments, the hinges 100A-100C are configured to be movable between first or retracted positions and second or extended positions with respect to the first panel 14 and second panel 16. The hinges 100A-100C can be configured for operation in the disconnected states when in the retracted positions. Conversely, the hinges 100A-100C can be configured for operation in the connected states when in the extended positions. Hinge retraction assemblies 112A-112C can be associated with the hinges 100A-100C, respectively, and are operable to move the hinges between the retracted and extended positions.

Figure 12:
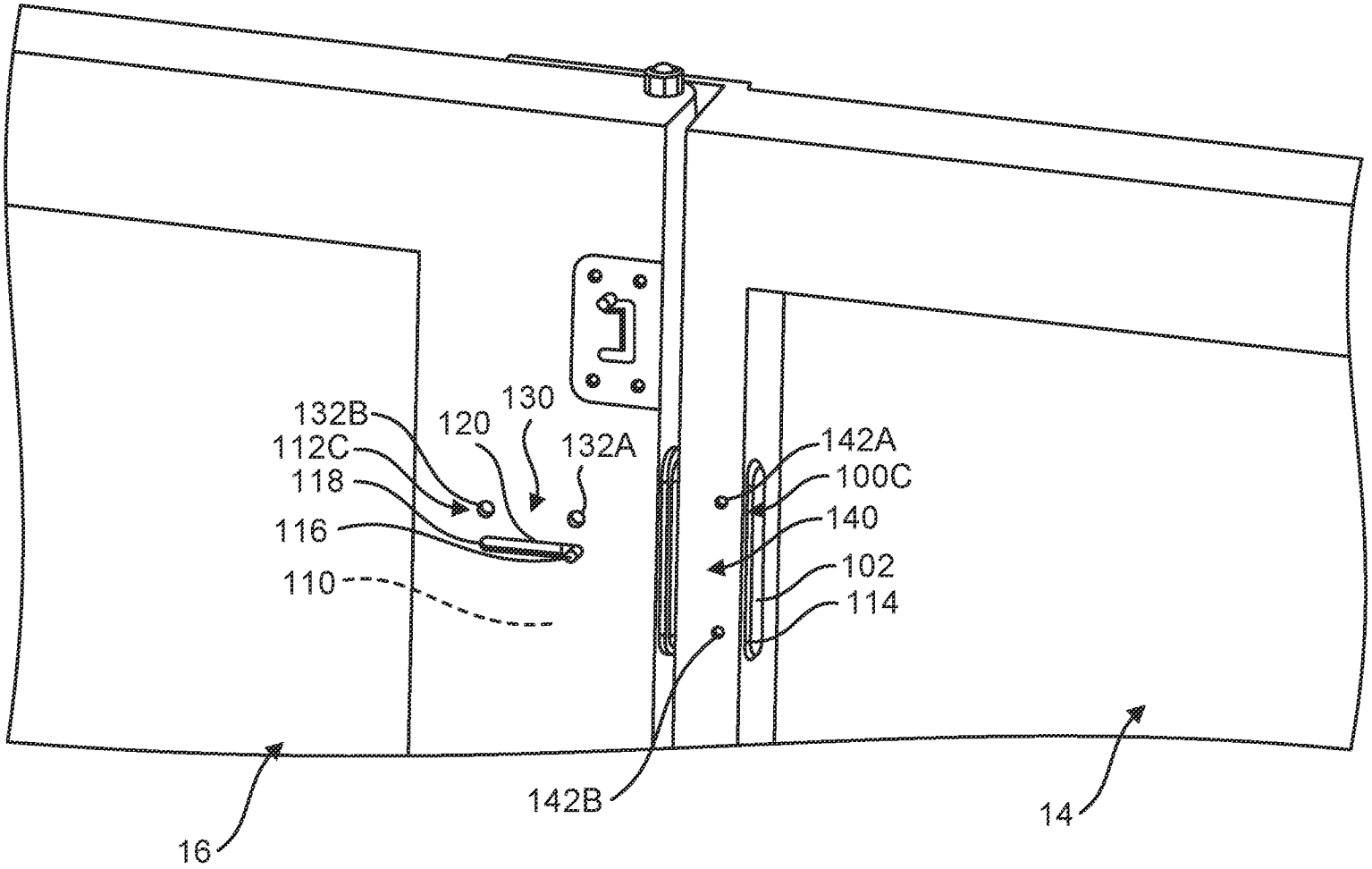
FIG. 12 is a detailed isometric view of a portion of a door such as that shown in FIG. 1, showing a hinge retraction assembly and a hinge latch.

In various embodiments, the hinges 100A-100C can be housed or garaged within the first stile 54 of the second panel 16 when the hinges are in the retracted positions and disconnected states. For example, the first stile 54 of the second panel 16 can include first pockets or recesses 110 for the hinges 100A-100C. In the illustrated examples, the recesses 110 are sufficiently large to substantially or fully enclose the hinges 100A-100C (i.e., including both mounts 1021 and 1022) when the hinges are in the retracted positions. The second stile 46 of the first panel 14 includes corresponding second pockets or recesses 114 for receiving the mounts 1021 of the hinges 100A-100C when the hinges are in the extended positions and connected states. In embodiments, the recesses 114 are sufficiently large to substantially or fully enclose the mounts 1021. FIG. 12, for example, illustrates hinge 100C in the extended position and in its connected state, with the mount 1022 located within the recess 110 in the first stile 54 of second panel 16, and the mount 1021 extending outside and beyond the second panel into the recess 114 in the second stile 46 of the first panel 14. For purposes of illustration, FIG. 11 shows the hinge 100A in the extended position with the mount 1021 extending from the second panel 16, but with the mount 1021 not in the associated recess 114 of the first panel 14 (i.e., the hinge 100A is not shown in its connected state in FIG. 11). Although hinges 100A-100C are described as being configured to be garaged on the second panel 16 and movable between the retracted and extended positions on the second panel in the illustrated embodiments, in other embodiments the hinges can be configured to be garaged on movable with respect to the first panel 14.

As shown in FIGS. 6, 11 and 12, the hinge retraction assemblies 112A-112C each include a hinge control member 116 which is operably coupled to the associated hinge (e.g., to the associated mount 1022) such that the hinge control member can be actuated by a user to cause the hinge to transition between the retracted and extended positions. In various embodiments, the hinge control member 116 is slideably received in a hinge control cutout 118. The hinge control cutout 118 defines a path 120 that is traversable by the hinge control member 116. The path 120 of the hinge control cutout 118 is shown in FIGS. 6, 11 and 12 as being generally horizontal and linear, although other paths are contemplated. Accordingly, the illustrated example shown in FIGS. 6, 11 and 12 is not intended to be limiting, but may include any suitable path operable to be traversed by the hinge control member 116 to cause the associated hinge 100A-100C to be transitioned between the retracted and extended positions. FIGS. 6, 11 and 12 show the hinge control members 116 in positions on the paths 118 that cause the associated hinges 100A-100C to be at the extended positions. By actuating the hinge control members 116 (e.g., by moving the hinge control members to opposite positions on the paths 118), a user can transition the associated hinges 100A-100C to the retracted positions.

Embodiments of door 10 can include a latch 130 associated with one or more of the hinges 100A-100C. A latch 130 is associated with each of the hinges 100A-100C in the examples shown in FIGS. 6, 11 and 12. Latches 130 are operable to releasably connect or latch the mount 1022 of the associated hinge 100A-100C to the second panel 16 when the hinge is in either or both of the retracted and/or extended positions, and thereby constrain movement of the hinge in the second panel. In the illustrated embodiments, latches 130 are configured to releasably latch the mounts 1022 to panel 16 in both the retracted and extended positions. The embodiments of latches 130 shown in FIGS. 6, 11 and 12, for example, include a pair of spaced apart apertures 132A and 132B in the second panel 16, and a control member 134. Apertures 132A and 132B align with an aperture in the mount 1022 (not visible in FIGS. 6, 11, 12) when the mount is in the extended and retracted positions, respectively. As shown for example in FIG. 11, when the hinge 100A is in the extended position, the control member 134 can be inserted into and extended through the aperture 132A and into engagement with the aperture in the mount 1022 to constrain the mount 1022 to the panel 16 in the extended position. Similarly, when the hinge 100A is in the retracted position, the control member 134 can be inserted into and extended through the aperture 132B and into engagement with the aperture in the mount 1022 to constrain the mount 1022 to the panel 16 in the retracted position. The latches 130 associated with one or more of hinges 100B and 100C can be the same as or similar to the latch 130 described above associated with hinge 100A. Yet other embodiments include other latches having other structures to provide functionality similar to or the same as that of the latches 130 described above.

Embodiments of door 10 can include a connector 140 associated with one or more of the hinges 100A-100C. A connector 140 is associated with each of the hinges 100A-100C in the examples shown in FIGS. 6, 11 and 12. Connectors 140 are operable to releasably connect the hinges 100A-100C, for example via their mounts 1021, to the first panel 14 when the hinges are in the extended positions, and thereby configure the hinges for operation in the connected states by constraining the mounts in the first panel. The embodiments of connectors 140 shown in FIGS. 6, 11 and 12, for example, include one or more apertures such as 142A and 142B in the first panel 14, and one or more control members such as 144A and 144B. Apertures 142A and 142B align with apertures 146A and 146B in the mount 1021, respectively, when the mount is in the extended position within the recess 114 in the first panel 14. When the mount 1021 is located in recess 114 in this manner, the one or more control members 144A and 144B can be inserted through the apertures 132A and 132B and into the apertures 146A and 146B in the mount, respectively, to connect the mount to the first panel 14 and thereby configure the hinge in the connected state. The control members 144A and 144B can be removed from the first panel 14 to enable the hinges 100A-100C to be configured for the disconnected states. Other embodiments include other connectors having other structures to provide the functionality of the connectors 140 described above.

Other embodiments of door 10 include other structures for releasably pivotally connecting the first panel 14 and second panel 16. For example, the associated leafs or other sections of one or more pairs of hinge mount sections can be fixedly mounted to the second stile of the first panel and the first stile of the second panel, respectively, with the pairs of hinge mount sections adjacent to one other and having knuckles or other structures that can be joined by a pivot pin. The pivot pin can be inserted into and removed from the adjacent hinge mount sections to releasably pivotally connect the first panel and the second panel.

As described above, fenestration units such as door 10 can be operated in one or both of the sliding mode and the folding mode. For purposes of examples, the operation of door 10 in the sliding and folding modes is described below as beginning and ending with the door in its closed configuration. As shown in FIG. 1, for example, when the door 10 is in its closed configuration both the first panel 14 and the second panel 16 are in closed positions. The first panel 14 and second panel 16 form a barrier within the frame 12 when the door 10 is in the closed configuration in these examples.

During sliding mode operation of door 10, the first panel 14 can remain in its closed position, and the second panel 16 can slide between its closed position and a sliding open position as the door transitions between its closed configuration and sliding open configuration. To configure the door for operation in the sliding mode, the first panel 14 can be constrained to remain in its closed position. In embodiments, for example, one or more latches such as 70 can be actuated to the latched position and couple the portion of the first panel 14 proximate the second stile 46 to the frame 12. When latches 70 are in the latched positions, the first panel 14 is, for example, constrained against pivotal motion about the hinges 60.

The second panel 16 is disconnected from the first panel 14 during sliding mode operation of the door 10. In the illustrated embodiments, for example, the disconnected state of panels 14 and 16 can be caused by (1) actuating the connectors 140 to release the hinges 100A-100C from the first panel (i.e., if the hinges were not already in the disconnected states), (2) actuating the hinge retraction assemblies 112A-112C to move the hinges to the retracted positions on the second panel (i.e., if the hinges were not already in the retracted positions), and (3) actuating the latches 130 to latch the hinges onto the second panel at the retracted positions (i.e., if the hinges were not already latched to the retracted positions).

The second panel 16 of the illustrated embodiments is configured for sliding motion with respect to the first panel 14 during sliding mode operation of the door 10. In the illustrated embodiments, for example, the sliding configuration of the second panel 16 can be caused by actuating the first and second retraction assemblies 82A and 82B to move the riders 80B and 80C to the extended or transfer positions in the tracks 30B and 30A, respectively (i.e., if the riders 80B and 80C were not already in the extended positions).

When the second panel 16 is configured for sliding motion, the second panel can be slideably moved (i.e., slid) by a user between the closed position shown in FIG. 1 and the sliding open position shown in FIG. 2. In embodiments, the second panel 16 is supported for sliding motion during the sliding mode by the riders 80A-80D. The riders 80A and 80B which are on the top portion of the second panel 16 engage and are guided by the track 30B in head 22. Similarly, the riders 80C and 80D which are on the bottom portion of the second panel 16 engage and are guided by the track 30A in the sill 20. In the illustrated embodiments, during an initial portion of the transition from the closed position to the open sliding position, the second panel 16 will be guided for motion by the second portions 34A and 34B and third portions 36A and 36B of tracks 30A and 30B, respectively, in a direction that is generally transverse to the major planar surfaces of the first and second panels, from the closed position coplanar with the first panel to a position generally parallel to but not coplanar with the first panel. During the remainder of the transition from the closed position to the open sliding position in these embodiments, the second panel 16 is guided for motion by the first portions 32A and 32B of the tracks 30A and 30B, respectively, in a direction that is generally parallel to the first panel 14. The second panel 16 moves about a path generally parallel to the first panel 14 as the second panel transitions between its closed and open sliding positions in the illustrated embodiments because the initial portion of the path from the coplanar closed position to the position parallel and adjacent to the first panel is relatively short and limited with respect to the parallel portion of the path. In other embodiments (not shown) the second panel 16 is not coplanar with the first panel 14 when in the closed position, and the second panel moves about a path parallel and adjacent to the first panel throughout the transition between its closed position and open sliding position. The second panel 16 can be transitioned from the open sliding position (e.g., as shown in FIG. 2) to its closed position (e.g., as shown in FIG. 1) by steps similar to those described above, but in the reverse order and direction.

During folding mode operation of the door 10, the first panel 14 and the second panel 16 are pivotally connected to one another about a folding axis (i.e., in the connected state), and fold with respect to one another about the folding axis as the door 10 transitions between the closed configuration shown in FIG. 1 and the folding open configuration shown, for example, in FIG. 3. Accordingly, to configure the door 10 for operation in the folding mode, the first panel 14 is pivotally connected to the second panel 16. In the illustrated embodiments, for example, the connected configuration of first panel 14 and second panel 16 can be caused by (1) actuating the latches 130 to release the hinges 100A-100C (i.e., if the hinges are latched to the retracted positions), (2) actuating the hinge retraction assemblies 112A-112C to move the hinges to the extended positions on the second panel (i.e., if the hinges were not already in the extended positions), (3) actuating the connectors 140 to connect the hinges 100A-100C to the first panel (i.e., if the connectors were not already in the connected states), and (4) actuating the latches 130 to latch the hinges onto the second panel at the extended positions (i.e., if the hinges were not previously latched at the extended positions).

The first panel 14 is configured for pivoting motion with respect to the frame 12 during operation in the folding mode. In the illustrated embodiments, for example, the first panel 14 is configured to pivot by actuating the one or more latches such as 70 to the released position. The second stile 46 of the first panel 14 is thereby decoupled from the from the frame 12, enabling the first panel to pivot about the hinges 60.

The second panel 16 is configured for both pivoting or rotational motion with respect to the frame 12, and for sliding motion with respect to the frame, during operation in the folding mode. In the illustrated embodiments, for example, the pivoting and sliding configuration of the second panel 16 can be caused by actuating the first and second retraction assemblies 82A and 82B to the retracted positions to move the riders 80B and 80C to positions withdrawn from the tracks 30B and 30A, respectively (i.e., if the retraction assemblies were not previously in the retracted positions). When the second panel 16 is configured for pivoting and sliding motion, the second panel is supported with respect to the frame 12 by the riders 80A and 80D. The rider 80A which is on the top portion of the second panel engages and is guided by the track 30B in head 22. Similarly, the rider 80D which is on the bottom portion of the second panel 16 engages and is guided by the track 30A in the sill 20.

Figure 10:
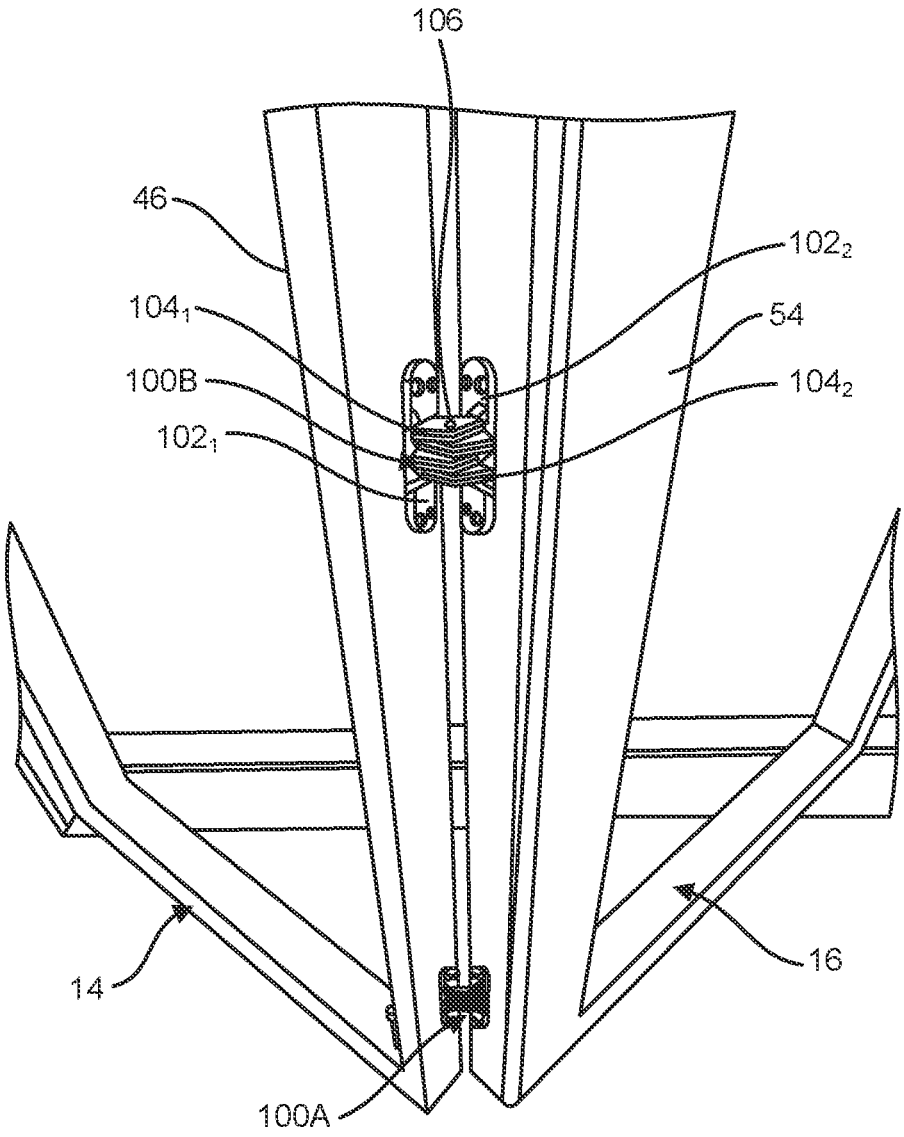
FIG. 10 is a detailed isometric view of a portion of a door such as that illustrated in FIG. 1, shown in a partially folding open configuration.

With door 10 configured for folding mode operation, for example in the manner described above, the first panel 14 and second panel 16 will fold with respect to one another about the folding axis defined by the hinges 100A-100C as the door 10 is transitioned to the folding open configuration shown in FIG. 3. During this folding open transition of the door 10, the first panel 14 pivots or rotates about the hinges 60 with respect to the frame 12 as the first panel extends out of the frame. As shown in FIGS. 3 and 10, for example, the second stile 46 of the first panel 14 swings outwardly from the frame 12 during this pivoting motion because the second side portion (e.g., the second stile 46) is decoupled from the frame. Concurrently with this pivoting motion of the first panel 14, the second side portion (e.g., the second stile 56) of the second panel 16 slides along the frame 12 toward the first panel, and pivots with respect to the frame as the second panel extends out of the frame. In the illustrated embodiments, the sliding and pivoting motion of the second panel 16 are guided by the riders 80A and 80D in the third portions 36B and 36A and first portions 32B and 32A, of tracks 30B and 30A, respectively, as the second panel moves from its closed position to its folding open position. As shown in FIGS. 3 and 10, for example, the first stile 54 of the second panel 16 swings outwardly from the frame 12 during this sliding and pivoting motion, at least in part because of the pivotal connection of the first stile 54 to the second stile 46 of the first panel 14 by the hinges 100A-100C. FIG. 3 shows the door 10 in is folding open configuration, with the first panel 14 is in the folding open position and the second panel 16 in its folding open position. Door 10 can be transitioned from its folding open configuration to its closed configuration by moving the first panel 14 and second panel 16 from their folding open positions to their closed positions by steps similar to those described above, but in the reverse order and direction.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. A fenestration unit operable in a sliding mode and a folding mode, comprising:

a frame;

a first panel supported by the frame and defined by first and second opposite side portions, wherein the first panel is mounted to enable the first panel to pivot about the first side portion with respect to the frame;

a second panel supported by the frame and defined by first and second opposite side portions, wherein the second panel is mounted to enable the second panel to (1) slide with respect to the frame, and (2) pivot about the second side portion of the second panel with respect to the frame; and one or more fold hinges configured to releasably pivotally connect the second side portion of the first panel to the first side portion of the second panel and define a folding axis;

wherein in the sliding mode (1) the one or more fold hinges are configured to disconnect the first and second panels, (2) the first panel is in a closed position with respect to the frame, and (3) the second panel is configured to slide along a path generally parallel to the first panel between a closed position and a sliding open position; and wherein in the folding mode (1) the one or more fold hinges are configured to pivotally connect the second side portion of the first panel and the first side portion of the second panel, and (2) the first panel and second panel fold with respect to one another about the folding axis with the first panel pivoting with respect to the frame and the second panel sliding and pivoting with respect to the frame as the first and second panels move between the closed positions and folding open positions.

2. The fenestration unit of claim 1 wherein each of the one or more fold hinges includes:

a first mounting portion mounted to one of the second side portion of the first panel or the first side portion of the second panel; and a second mounting portion pivotally connected to the first mounting portion and configured to be connected to and disconnected from the other of the second side portion of the first panel or the first side portion of the second panel.

3. The fenestration unit of claim 2 wherein each of the one or more fold hinges is mounted to the one of the second side portion of the first panel or the first side portion of the second panel such that the hinge is configured for movement between a retracted position and an extended position, and wherein (1) when the fold hinge is in the retracted position the first mounting portion and the second mounting portion are on the one of the second side portion of the first panel or the first side portion of the second panel to enable operation of the fenestration unit in the sliding mode, and (2) when the fold hinge is in the extended position the first mounting portion is on the one of the second side portion of the first panel or the first side portion of the second panel, and the second mounting portion extends from the one of the second side portion of the first panel or the first side portion of the second panel and is configured to be connected to and disconnected from the other of the second side portion of the first panel or the first side portion of the second panel to enable operation of the fenestration unit in the folding mode.

4. The fenestration unit of claim 3 wherein:

the one of the second side portion of the first panel or the first side portion of the second panel includes a first recess associated with each of the one or more folding hinges, each first recess is configured to receive the first mounting portion and the second mounting portion of the hinge when the hinge is in the retracted position; and the other of the second side portion of the first panel or the first side portion of the second panel includes a second recess associated with each of the one or more folding hinges, each second recess is configured to receive the second mounting portion of the hinge when the hinge is in the extended position.

5. The fenestration unit of claim 4 and further including a connector associated with each of the one or more fold hinges, each connector configured to connect the second mounting portion of the hinge to the other of the second side portion of the first panel or the first side portion of the second panel when the hinge is in the extended position.

6. The fenestration unit of claim 1 and further including a latch operable between a latched position and a release position, and wherein (1) when in the latched position the latch constrains pivotal motion of the first panel to enable operation of the fenestration unit in the sliding mode, and (2) when in the release position the latch enables the first panel to pivot during operation of the fenestration unit in the folding mode.

7. The fenestration unit of claim 1 and further including one or more operable transfer mechanisms operable between a transfer position and a release position, and wherein (1) when in the transfer position the transfer mechanism couples the first side portion of the second panel to the frame to enable the second panel to slide with respect to the frame in the sliding mode, and (2) when in the release position the transfer mechanism decouples the first side portion of the second panel from the frame to enable the second panel to fold with respect to the first panel in the folding mode.

8. The fenestration unit of claim 7 and further including one or more fixed transfer mechanisms coupling the second end portion of the second panel to the frame, and wherein each fixed transfer mechanism is configured to (1) enable the second end portion of the second panel to slide with respect to the frame in the sliding mode, and (2) enable the second end portion of the second panel to slide and rotate with respect to the frame in the folding mode.

9. The fenestration unit of claim 1 wherein the first panel and second panel are coplanar when in the closed positions.

10. The fenestration unit of claim 1 and further including one or more hinges coupling the first side portion of the first panel to the frame to enable the first panel to pivot with respect to the frame.

11. A fenestration unit operable in a sliding mode and a folding mode, comprising:

a frame including a sill, a head, a first jamb, and a second jamb;

a first panel including a first rail, a second rail, a first stile and a second stile, wherein the first panel is defined by a first side portion and an opposite second side portion;

a pivot connector pivotally coupling the first side portion of the first panel to the frame;

one or more latches, each latch operable between a latched position and a release position, wherein each latch is configured to (1) when in the latched position, constrain pivotal motion of the first panel with respect to the frame, and (2) when in the release position, enable the first panel to pivot with respect to the frame;

a second panel including a first rail, a second rail, a first stile and a second stile, wherein the second panel is defined by a first side portion and an opposite second side portion;

one or more fixed transfer mechanisms, each fixed transfer mechanism pivotally and slidably coupling the second side portion of the second panel to the frame;

one or more operable transfer mechanisms, each operable transfer mechanism operable between a transfer position and a release position, wherein each operable transfer mechanism is configured to (1) when in the transfer position, slidably couple the second panel to the frame, and (2) when in the release position, enable the second panel to pivot and slide with respect to the frame;

one or more fold hinges operable between a disconnected state and a connected state to releasably pivotally connect the second side portion of the first panel to the first side portion of the second panel and define a folding axis;

wherein in the sliding mode:

each latch can be in the latched position;

each fold hinge is in the disconnected state to disconnect the first and second panels;

each operable transfer mechanism is in the transfer position; and the first panel is supported with respect to the frame at a first panel closed position, and the second panel is supported with respect to the frame by the one or more operable transfer mechanisms and the one or more fixed transfer mechanisms, configuring the second panel to slide along a path generally parallel to the first panel between a second panel closed position and a second panel sliding open position; and wherein in the folding mode:

each latch is in the release position;

each fold hinge is in the connected state to pivotally connect the second side portion of the first panel and the first side portion of the second panel;

each operable transfer mechanism is in the release position; and the first panel is supported with respect to the frame by the pivot connector and the second panel is supported with respect to the frame by the one or more fixed transfer mechanisms, configuring the first panel and the second panel fold with respect to one another about the folding axis and extend out of the frame as the first panel pivots with respect to the frame between the first panel closed position and a first panel folding open position and the second panel slides and pivots with respect to the frame between the second panel closed position and a second panel folding open position.

12. The fenestration unit of claim 11 wherein the pivot connecter includes one or more hinges coupling the first side portion of the first panel to the frame.

13. The fenestration unit of claim 11 wherein each of the one or more fold hinges includes:

a first mounting portion mounted to one of the second side portion of the first panel or the first side portion of the second panel; and a second mounting portion pivotally connected to the first mounting portion and configured to be releasably connected to the other of the second side portion of the first panel or the first side portion of the second panel; and wherein (1) when in the connected state the second mounting portion is connected to the other of the second side portion of the first panel or the first side portion of the second panel, and (2) when in the disconnected state, the second mounting portion is disconnected from the other of the second side portion of the first panel or the first side portion of the second panel.

14. The fenestration unit of claim 13 wherein each of the one or more fold hinges is mounted to the one of the second side portion of the first panel or the first side portion of the second panel such that the hinge is operable between a retracted position and an extended position, and wherein (1) when in the retracted position and disconnected state, the first mounting portion and the second mounting portion are on the one of the second side portion of the first panel or the first side portion of the second panel, and (2) when in the extended position and connected state, the first mounting portion is on the one of the second side portion of the first panel or the first side portion of the second panel, and the second mounting portion extends from the one of the second side portion of the first panel or the first side portion of the second panel and is connected to the other of the second side portion of the first panel or the first side portion of the second panel.

15. The fenestration unit of claim 14 wherein:

the one of the second side portion of the first panel or the first side portion of the second panel includes a first recess associated with each of the one or more folding hinges, and wherein each first recess is configured to receive the first mounting portion and the second mounting portion of the hinge when the hinge is in the retracted position; and the other of the second side portion of the first panel or the first side portion of the second panel includes a second recess associated with each of the one or more folding hinges, and wherein each second recess is configured to receive the second mounting portion of the hinge when the hinge is in the extended position.

16. The fenestration unit of claim 15 and further including a connector associated with each of the one or more fold hinges, each connector configured to (1) connect the second mounting portion of the hinge to the other of the second side portion of the first panel or the first side portion of the second panel when the hinge is in the extended position and connected state, and (2) disconnect the second mounting portion of the hinge from the other of the second side portion of the first panel or the first side portion of the second panel when the hinge is in the retracted position and disconnected state.

17. The fenestration unit of claim 16 wherein the first panel and the second panel are coplanar when the first panel is in the closed position and the second panel is in the closed position.

18. The fenestration unit of claim 11 wherein the first panel and the second panel are coplanar when the first panel is in the first panel closed position and the second panel is in the second panel closed position.

* * * * *